US011655708B2

(12) United States Patent
Gao et al.

(10) Patent No.: US 11,655,708 B2
(45) Date of Patent: May 23, 2023

(54) TELEMETRY USING PULSE SHAPE MODULATION

(71) Applicant: Halliburton Energy Services, Inc., Houston, TX (US)

(72) Inventors: Li Gao, Katy, TX (US); Ravi P. Nanayakkara, Kingwood, TX (US); Joni Polili Lie, Spring, TX (US); Mukul M. Agnihotri, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 17/037,362

(22) Filed: Sep. 29, 2020

(65) Prior Publication Data

US 2022/0098978 A1 Mar. 31, 2022

(51) Int. Cl.
*E21B 47/20* (2012.01)
*E21B 34/08* (2006.01)

(52) U.S. Cl.
CPC ..... *E21B 47/20* (2020.05); *E21B 34/08* (2013.01)

(58) Field of Classification Search
CPC ..... E21B 47/20; E21B 34/08
See application file for complete search history.

(56) References Cited

U.S. PATENT DOCUMENTS

| | | | | |
|---|---|---|---|---|
| 3,707,700 | A | 12/1972 | Lafont | |
| 4,771,408 | A | 9/1988 | Kotlyar | |
| 6,282,405 | B1 * | 8/2001 | Brown | H04B 3/56 307/3 |
| 7,417,920 | B2 | 8/2008 | Hahn et al. | |
| 2010/0188253 | A1 | 7/2010 | Shearer | |
| 2014/0340991 | A1 * | 11/2014 | Ortiz | E21B 47/18 367/84 |
| 2015/0025806 | A1 | 1/2015 | Pillai et al. | |
| 2015/0330217 | A1 * | 11/2015 | Liu | H04B 13/02 367/83 |
| 2016/0245078 | A1 * | 8/2016 | Mahmoud | E21B 47/18 |
| 2016/0362976 | A1 | 12/2016 | Petrovic et al. | |
| 2018/0245461 | A1 | 8/2018 | Barak | |
| 2021/0247538 | A1 * | 8/2021 | Guedes | G01N 33/383 |

FOREIGN PATENT DOCUMENTS

| | | | | |
|---|---|---|---|---|
| EP | 0398581 | A2 | 11/1990 | |
| EP | 0916807 | A2 * | 5/1999 | E21B 47/20 |
| WO | WO-2016114752 | A1 * | 7/2016 | E21B 47/20 |
| WO | WO-2017164867 | A1 * | 9/2017 | E21B 49/003 |

OTHER PUBLICATIONS

PCT Application No. PCT/US2020/053438, International Search Report, dated May 27, 2021, 4 pages.
PCT Application No. PCT/US2020/053438, Written Opinion, dated May 27, 2021, 5 pages.

* cited by examiner

*Primary Examiner* — Nabil H Syed
*Assistant Examiner* — Cal J Eustaquio
(74) *Attorney, Agent, or Firm* — Delizio, Peacock, Lewin & Guerra

(57) ABSTRACT

A downhole telemetry method and system are disclosed. In some embodiment, a method includes driving a pulser device based on an input data stream, wherein driving the pulser device includes generating modulated pressure pulses including modulated pulse shapes within a fluid telemetry medium. In some embodiments in which bi-modulation is utilized, the method further includes driving the pulser device including modulating pressure pulses including pulse position modulating pressure pulses.

19 Claims, 19 Drawing Sheets

TELEMETRY USING PULSE SHAPE MODULATION

TECHNICAL FIELD

The disclosure generally relates to signal modulation and to drilling system telemetry techniques that utilize pulse shape modulation.

BACKGROUND

Drilling and production operations may require large amounts of information transmitted relating to parameters and conditions downhole. Such information may include characteristics of the earth formations traversed by a wellbore, in addition to data relating to the size and configuration of the borehole itself. The collection of information relating to conditions downhole is commonly referred to as logging. Logging while drilling (LWD) and measurement while drilling (MWD) are logging techniques utilized to evaluate downhole physical properties while drilling within wellbores. Measurement and other downhole data may also be collected by wireline following or between drilling intervals. The measurements are performed downhole and the measurement data may be stored in local tool memory and subsequently or concurrently transmitted to surface data processing and storage equipment.

Formation evaluation and drilling dynamics data improve efficiency of drilling and location of target formations. Telemetry systems transmit downhole data from downhole MWD/LWD or wireline tools to the surface to provide surface computation resources with location specific drilling and formation data. Common types of downhole telemetry used for transmitting downhole data include mud pulse, electromagnetic, and others. The telemetry equipment may be configured to implement a variety of data transmission methods that entail data encoding and decoding using some form of modulation of signals carried on electromagnetic (EM) waves and/or pressure waves such as pressure pulses in a fluid telemetry system. Borehole fluid telemetry systems produce fluid pulse telemetry signals comprising transient borehole fluid pressures variations. The fluid pulse telemetry signals often comprise data pulses produced by a valve arrangement (e.g., a rotary shear valve or a poppet valve). The rate of data pulse production, and therefore of transmission bandwidth, may be limited by the mechanics of the particular apparatus used in generating fluid pulses downhole.

Mud pulse telemetry is a common form of fluid telemetry that modulates the flow of drilling fluid (drilling "mud"), encoding downhole measurement data in a pressure pulse stream that propagates through the drillstring and is detected by surface pressure transducers. For mud system pressure pulses, the carrier waves may have various signal characteristics such as polarity (positive/negative) and pulse shape, periodicity, etc. Systems employing mud pulse telemetry face various sources of degradation, including drilling noise, noise from motion of the drilling string within the borehole, attenuation, and noise from the circulation pumps. To address these issues, mud pulse telemetry systems have relied on fixed width pulses selected to be long enough to support long integration times (relative to the time characteristics of the interfering noise sources), yet short enough to minimize the effect of baseline pressure drift. The bandwidth limitations associated with such acoustic interference and as well as with telemetry equipment and the drilling mud signaling medium may result in sub-optimal transmission rates that may substantially lag the data sourcing capacity of downhole data collection systems.

BRIEF DESCRIPTION OF THE DRAWINGS

Embodiments of the disclosure may be better understood by referencing the accompanying drawings.

DESCRIPTION OF EMBODIMENTS

The description that follows includes example systems, methods, techniques, and program flows that embody embodiments of the disclosure. However, it is understood that this disclosure may be practiced without these specific details. In other instances, well-known instruction instances, protocols, structures and techniques have not been shown in detail in order not to obfuscate the description.

Overview

The various embodiments are directed to telemetry that may be utilized for downhole applications such as for transmitting logging data from downhole sensors to surface receiver equipment. The disclosed methods and systems include a variety of coding (encoding/decoding) techniques in which data rate may be increased by leveraging aspects of fluid pressure telemetry. The following description discloses, among other things, various mud pulse telemetry encoding techniques that utilize pulse shape modulation (PSM) telemetry to encode data by leveraging controllable fluid pressure pulse shapes. While some embodiments implement PSM for mud pulse telemetry, alternate embodiments may employ PSM for other types of telemetry such as electromagnetic or optical telemetry.

The disclosed mud pulse telemetry encoding and decoding techniques may comprise a combination of pulse position modulation (PPM) and PSM to increase the telemetry data rate and available bandwidth. The resultant coding techniques transmit data by the position of upward and/or downward pulse transitions in combination with pulse shapes, significantly increasing telemetry channel bandwidth and coding efficiency. In some variations, the available bandwidth may be further increased by providing two or more PSM schemas having different data encoding densities that are selectable based on downhole acoustic telemetry conditions and possibly other factors.

Example Illustrations

Figure 1:
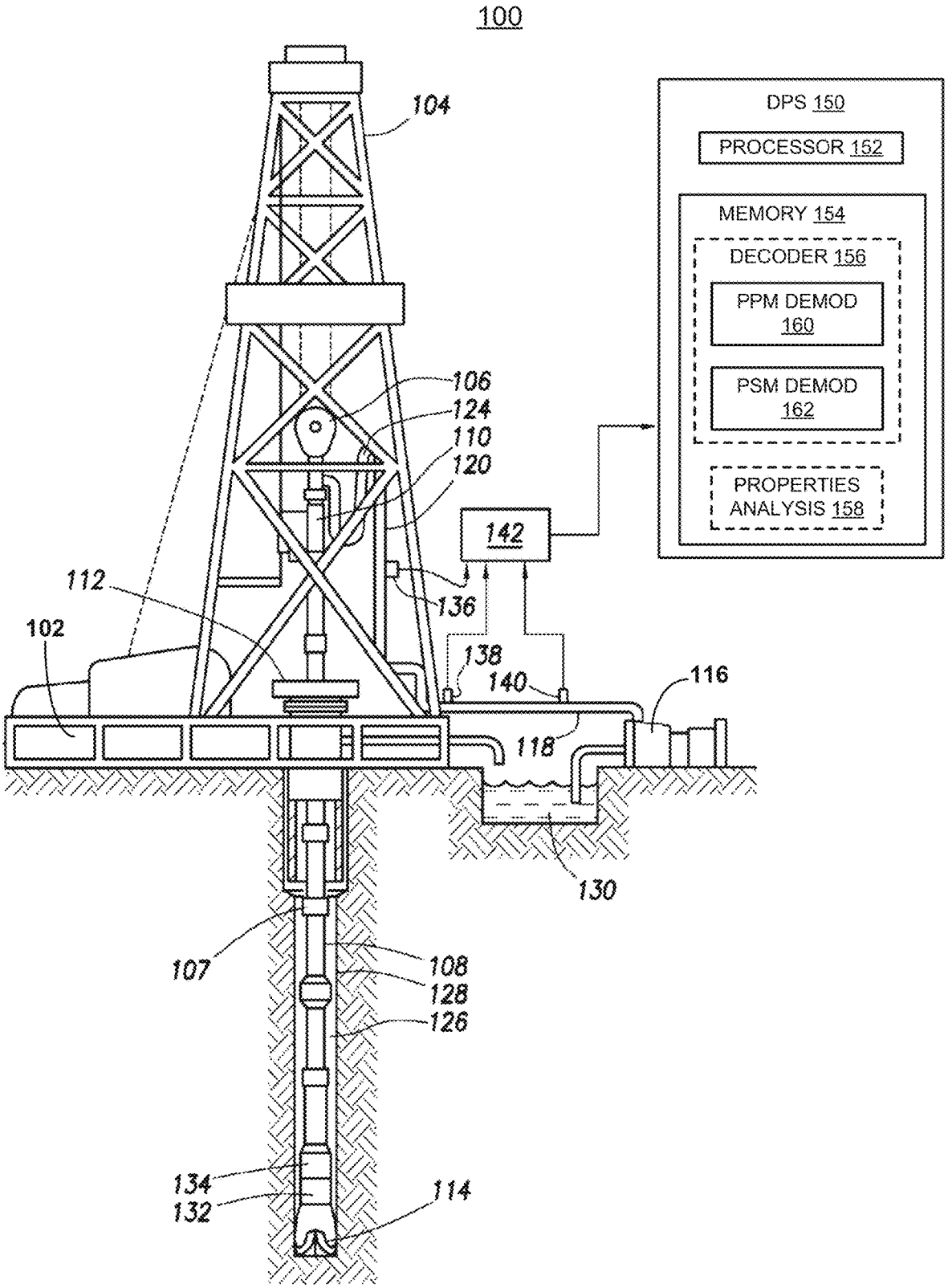
FIG. 1 depicts a drilling system configured to perform bi-modulated mud pulse telemetry in accordance with some embodiments.

FIG. 1 depicts a drilling system 100 configured to perform bi-modulated mud pulse telemetry in accordance with some embodiments. A drilling platform 102 is equipped with a derrick 104 that supports a hoist 106. Drilling of hydrocarbon wells is performed by a string of drill pipes connected by tool joints 107 to form a drill string 108. The hoist 106 suspends a top drive 110 that is used to rotate drill string 108 and to lower it through a wellhead 112. A drill bit 114 is connected to the lower end of drill string 108. During drilling operations, drilling fluid, sometimes referred to as drilling mud, is pumped by a mud pump 116 through a flow line 118, a stand pipe 120, a goose neck 124, top drive 110, and down through drill string 108 at high pressures and volumes to pass through nozzles or jets within drill bit 114. The drilling fluid then travels back up the borehole via an annulus 126 formed between the exterior of drill string 108 and a borehole wall 128, and into a mud pit 130 on the surface. On the surface, the drilling fluid is cleaned and again circulated by mud pump 116. The drilling fluid is used to cool drill bit 114, to transport cuttings from the base of the bore to the surface, and to balance the hydrostatic pressure in the rock formations.

In wells employing mud pulse telemetry for logging while drilling (LWD) and/or measuring while drilling (MWD), one or more downhole tools 132 collect data regarding the formation properties, downhole conditions such as pressure and temperature, and/or various drilling parameters. Downhole tools 132 are coupled to a telemetry module 134 that transmits the data to the surface. Telemetry module 134 modulates a resistance to drilling fluid flow to generate pressure pulses that propagate as acoustic signals traveling at the speed of sound through drill string 108 to the surface. Various transducers, such as transducers 136, 138, and 140, convert the pressure signal into electrical signals for a signal digitizer 142 (e.g., an analog to digital converter). While three transducers 136, 138 and 140 are illustrated, a greater number of transducers, or fewer transducers, may be used in particular situations. Digitizer 142 supplies a digital form of the detected analog pressure signals to a data processing system 150 or some other form of a data processing device. Data processing system 150 operates in accordance with program code embodied and stored in computer-readable storage media as microcode, firmware, and software to process and decode the pressure pulse signals received by transducers 136, 138, and 140. The resulting telemetry data may be further analyzed and processed by data processing system 150 to generate a display of useful information. For example, a human or programmed electromechanical driller entity may utilize data processing system 150 to obtain and monitor bottom hole assembly (BHA) position and orientation information, drilling parameters, and formation properties.

Telemetry module 134 generates a traveling pressure signal representative of measured downhole parameters. In an ideal system, each downhole pressure pulse propagates upstream (i.e., against the flow of drilling fluid within drill string 108) and is clearly detected by a transducer at the surface. However, drilling fluid pressure fluctuates significantly and contains noise from several sources (e.g., bit noise, torque noise, and mud pump noise). Bit noise is created by vibration of the drill bit during drilling operations. As drill bit 114 moves and vibrates, the drilling fluid exiting drill bit ports may be partially or temporarily restricted, creating a high frequency noise in the pressure signal. Torque noise is generated downhole by the action of drill bit 114 sticking in a formation, causing drill string 108 to torque up. The subsequent release of drill bit 114 relieves the torque on drilling string 108 and generates a low frequency, high amplitude pressure surge. Finally, mud pump 116 generates cyclic noise as the pistons within the pump force the drilling fluid into the drill string.

Drilling system 100 includes telemetry systems, devices, and components that implement pressure wave/pulse modulation techniques that address the multiple sources of downhole acoustic noise interference while maximizing telemetry data rate and bandwidth. In some embodiments, telemetry module 134 is configured to implement pressure pulse modulation that includes modulating the shapes of individual pressure pulses. For example, telemetry module 134 may include or be operatively coupled to a pulser device including a mud pulse valve. The pulser device may further include a valve controller such as a solenoid or motor and associated pulse controller programming that controls the opening and closing, including the speed of opening and closing, of the mud pulse valve which ultimately generates the pressure pulses within drill string 108. In some embodiments, drilling system 100 implements pulse shape modulation (PSM) in which the shape of individual pressure pulses is encoded/modulated in a manner such that each of two or more pulse shapes corresponds to a respective data symbol such as a logic one (bit 1) or logic zero (bit 0) and/or multi-bit data words. In some embodiments, drilling system 100 implements bi-modulation in which the pressure pulse stream is modulated using pulse position modulation (PPM) in combination with PSM. For embodiments in which drilling system 100 implements PPM, telemetry module 134 is further configured using electronic and program devices and components to modulate the pressure pulse signals by modulating the separations (e.g., temporal spacings) between consecutive pressure pulses. In this manner drilling system 100 is configured to maximize encoding and transmission capacity by utilizing both pulse shape and separations between pulses to substantially increase data transmission bandwidth.

Drilling system 100 includes receiver components configured to detect and decode/demodulate PSM encoded and bi-modulation encoded pressure pulse streams. In the depicted embodiment, the receiver components include transducers 136, 138, and 140, digitizer 142, and decoder components within data processing system 150. Transducers 136, 138, and 140 are disposed at various positions along the drilling fluid circulation system such as on standpipe 120 and flow line 118 to optimally detect pressure pulse acoustics signals transmitted along drill string 108 and convert the acoustic signals to electrical signals. Digitizer 142 is an analog-to-digital converter configured to generate digital signals corresponding to the electrical signals from the transducers.

The digital signals from digitizer 142 are transmitted to data processing system 150, which is configured to decode the signals and store and/or further process the decoded measurement data such as for formation analysis. As shown, data processing system 150 may operate at or above a terrain surface 103 within or proximate to other surface equipment. Data processing system 150 includes processing and storage components configured to receive, decode, and otherwise process downhole measurement information transmitted by telemetry module 134. Data processing system 150 comprises, in part, a computer processor 152 and memory device 154 configured to execute program instructions for decoding mud pulse signals generated by telemetry module 134. A decoder 156 and a properties analysis program 158 are stored and executed from memory 154. Decoder 156 comprises program instructions and data including a PPM demodulator 160 and a PSM demodulator 162 for decoding a bi-modulated signal stream. PPM demodulator 160 is configured to detect and decode the separations/spacings between consecutive pressure pulses to determine corresponding data symbols such as bits or data words. PSM demodulator 162 is configured to detect and decode the shapes, such as the amplitude contours, of each of the pulses to determine corresponding bits or data words. The decoded data from decoder 156 may be processed such as by properties analysis program 158 to determine formation properties or other downhole information.

Figure 2:
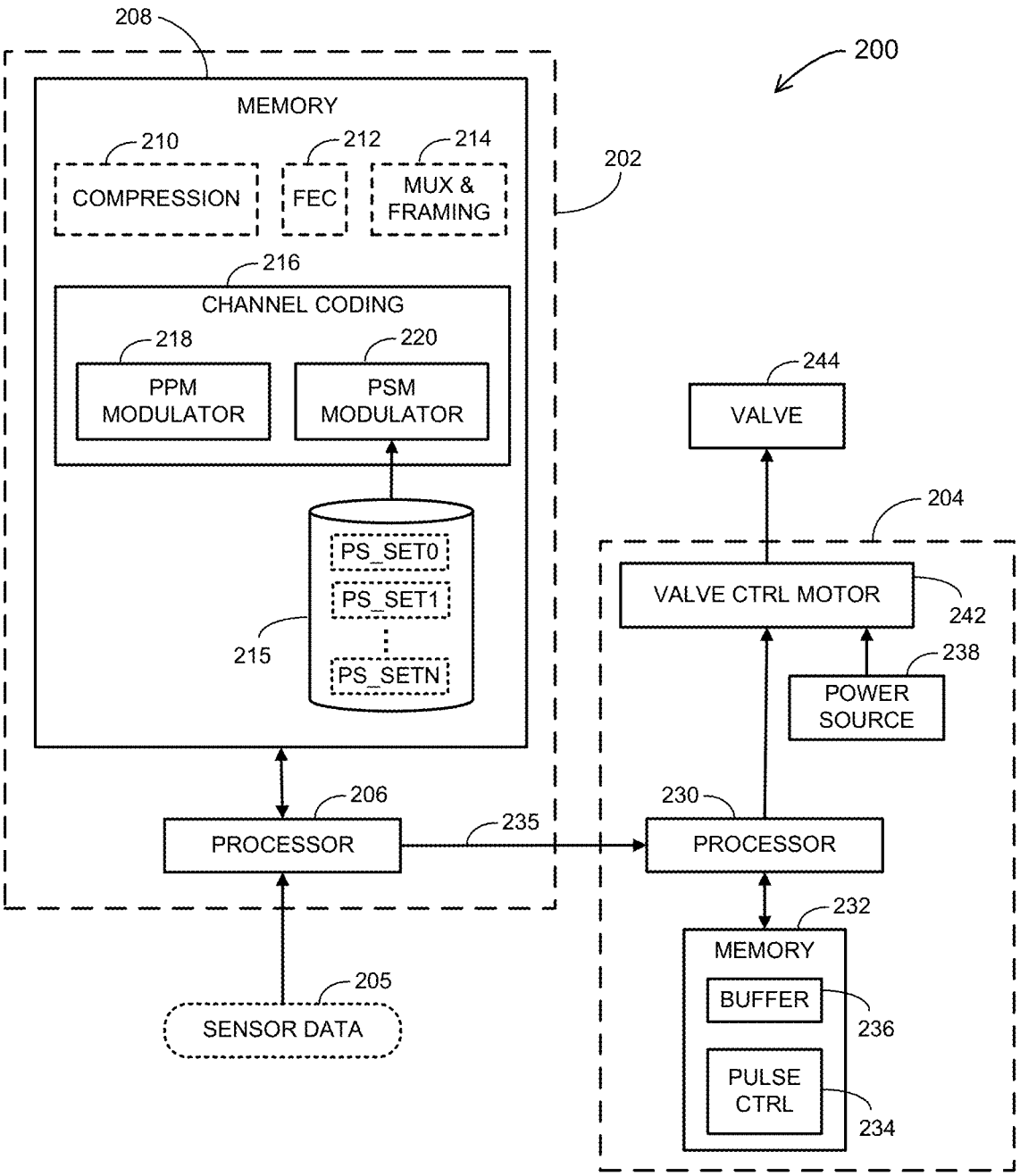
FIG. 2 illustrates a transmitter telemetry module in accordance with some embodiments.

FIG. 2 shows, in electrical block diagram form, a transmitter telemetry module 200 including components such as may be implemented by the telemetry module 134 in FIG. 1. Telemetry module 200 comprises two logical units, a communication unit 202 and a pulse control unit 204. While in some embodiments communication unit 202 and pulse control unit 204 are co-located in a single physical device, in other embodiments the communication unit 202 and pulse control unit 204 are incorporated in separate physical devices that are mechanically and electrically coupled together. Various downhole tools such as downhole tools 132 in FIG. 1 provide sensor data 205 to communication unit 200, and in particular to a processor 206 (e.g., a digital signal processor (DSP)).

Processor 206 operates in accordance with program code within a memory 208 to represent the sensor data 205 in the form of a digital transmit signal. In particular, the program code contained in memory 208 comprises multiple coded modules including a compression module 210, a forward error correction (FEC) module 212, a multiplexing and framing module 214, and a channel coding module 216. Compression module 210 processes the incoming sensor data using compression techniques to reduce the amount of transmitted data by eliminating some data points or by taking representative samples. In some cases, the data stream may be differentially encoded, so that differences between successive values rather than the values themselves are sent enabling a data stream to be represented with fewer bits. Other compression techniques may be equivalently used Multiplexing and framing module 214 selects sensor data from the various downhole tools to construct a single transmit data stream. The transmit data stream is divided into data blocks that may be accompanied by framing information in some embodiments. The framing information may include synchronization information and/or error correction information provided by forward error FEC module 212.

Channel coding module 216 includes a PPM modulator 218 configured to implement PPM encoding by converting at least a portion of the digitized sensor data 206 into sets of pulse separations (e.g., time offsets). In some embodiments, the pulse separations are defined by PPM modulator 218 encoding n bits by transmitting a pulse in one of $2^n$ possible time shifts between consecutive pulses. The precise nature of each of the sets of pulse separations depends on the particular pulse encoding system. Channel coding module 216 further includes a PSM modulator 220 configured to performed PSM encoding by converting at least a portion of the sensor data 206 into pulse shapes. PSM modulator 220 may implement one or more PSM schemas that may vary in terms of the number and types of available pulse shapes in each schema. The number of available pulse shapes available determines the per pulse encoding data density.

Figure 3:
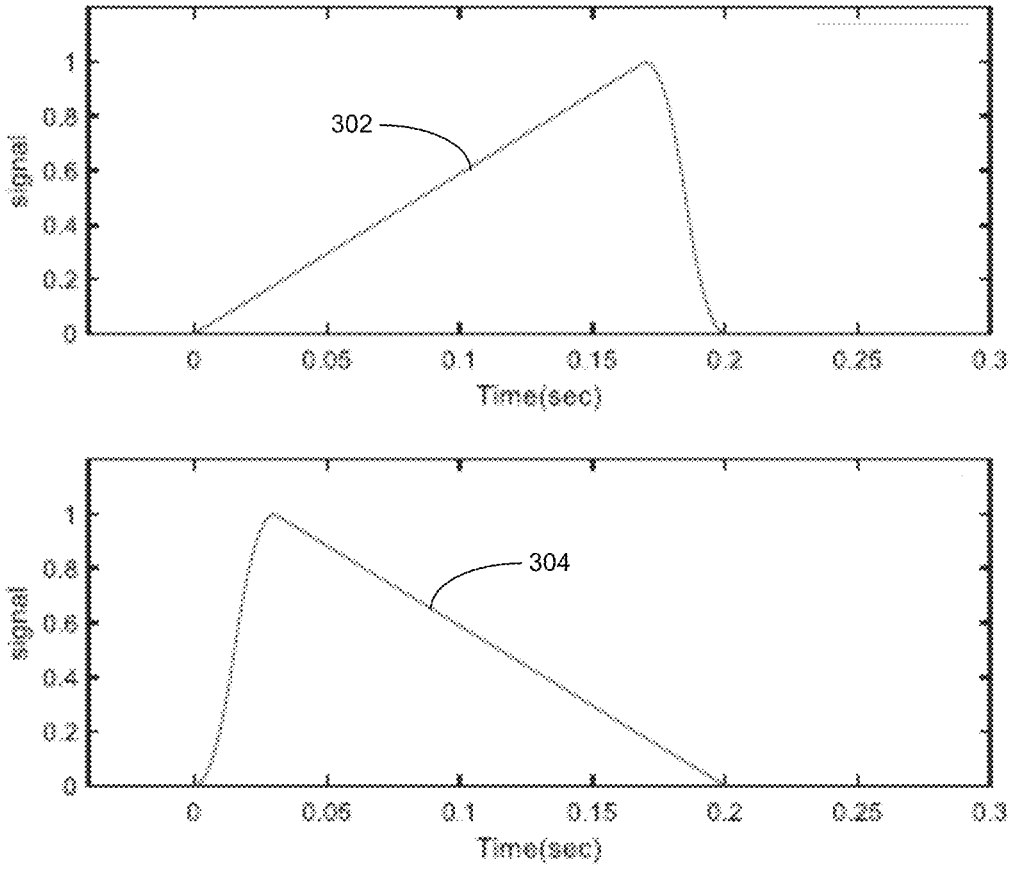
FIG. 3 depicts example control signals for generating two distinct pulse shapes for pulse shape modulation (PSM) in accordance with some embodiments.

For example, a first PSM encoding schema may represent a single binary bit such that two pulse shapes are included, one representing logic one and the other representing logic zero. FIG. 3 depicts examples of two such pulse shapes 302 and 304. As illustrated, pulse shape 302 represents bit 1 and has a relatively slow upward sloping amplitude contour (ramp) followed by a relatively rapid, sharp return to baseline. The slow upward contour forming a ramp corresponds to a slow open valve signal and the following sharp return corresponds to a fast close valve signal. Pulse shape 304 represents bit 0 and has a relatively fast, sharp rise followed by a downward sloping amplitude contour (ramped) return to baseline. The sharp upward rise to maximum amplitude corresponds to a fast open valve signal and the following downward ramping return to baseline contour corresponds to a slow close valve signal.

Figure 4:
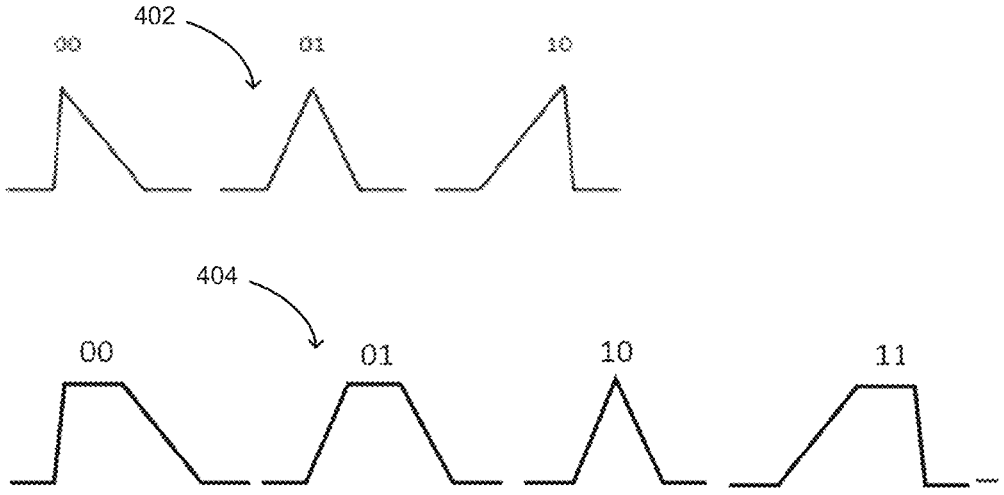
FIG. 4 illustrates pulse shapes that may be generated for PSM in accordance with some embodiments.

Differing downhole conditions such as determined by drill pipe distance, true vertical depth, and downhole and surface acoustic interference may enable a greater per-pulse PSM data density. Therefore, additional and/or alternative PSM encoding schema representing multi-bit data symbols (e.g., words) may be selectable by PSM modulator 220 based on such conditions. For example, FIG. 4 illustrates two PSM schemas having respective sets of pulse shapes that may be utilized by PSM modulator 220 in accordance with some embodiments. The first schema 402 includes three distinct pulse shapes that represent binary 00, 01, and 10, respectively. The second schema 404 includes four distinct pulse shapes that represent binary 00, 01, 10, and 11, respectively and thereby represent the full range of two-bit words. Returning to FIG. 2, PSM modulator 220 may select and execute a PSM encoding schema from a PSM schema library 215 that includes schemas PS_SET0 through PS_SETN.

Figure 7:
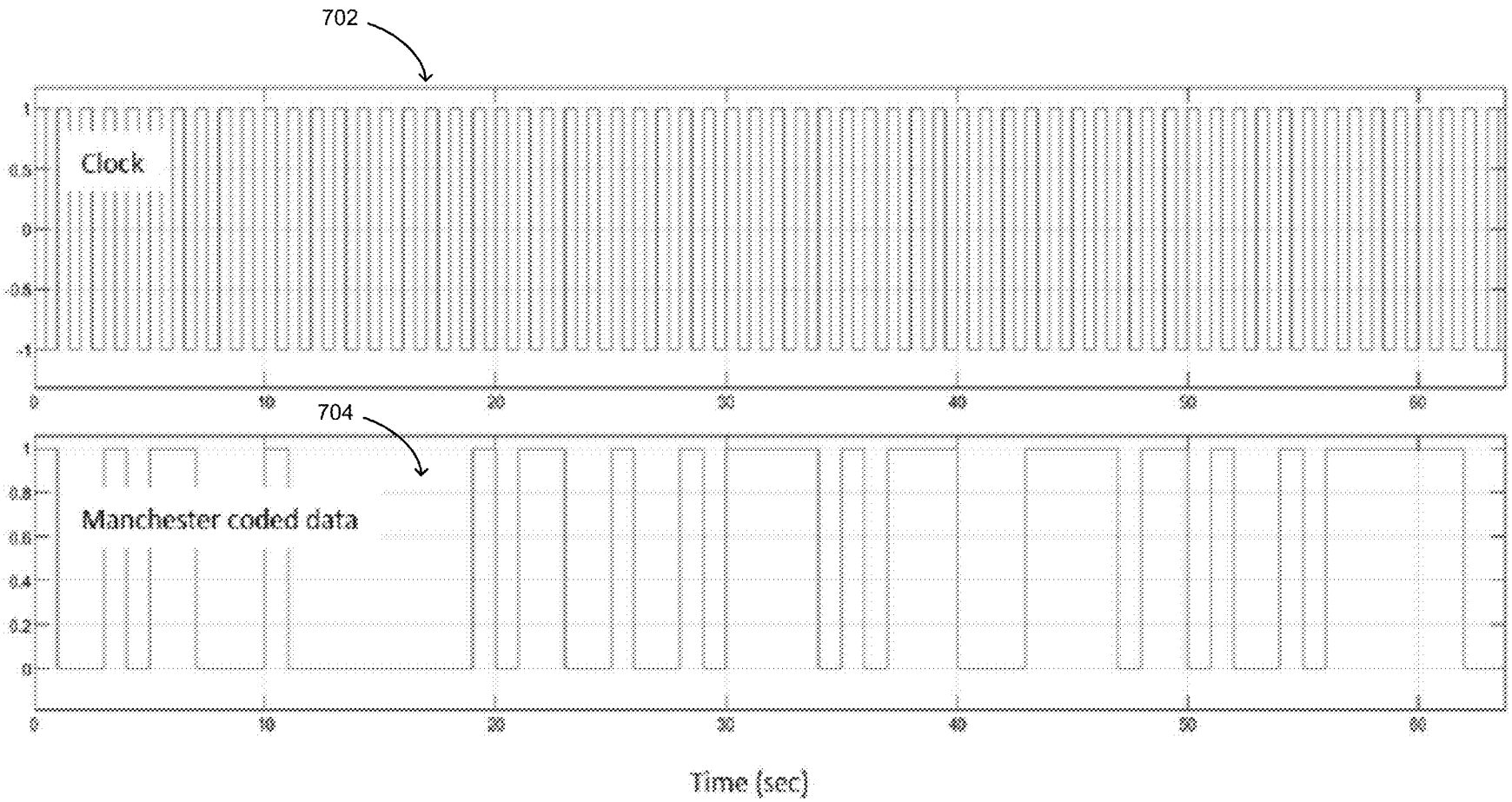
FIG. 7 depicts PSM encoding using Manchester coding for mud pulse or EM telemetry in accordance with some embodiments.

Some embodiments may use different pulse shaping encoding schemes based on different operating conditions and different transmission media (e.g., mud pulse versus electromagnetic (EM) telemetry). For example, a drilling system may employ an EM telemetry system in which Manchester encoding is used. FIG. 7 depicts PSM encoding using Manchester coding for mud pulse or EM telemetry in accordance with some embodiments. As shown in FIG. 7, a clock system 702 may be used for channel coding module 218 to implement modified Manchester encoding in which PSM modulator 220 generates an encoded data stream 704 based on the input data stream by using pulse shape sets that each include a number of two or more pulse widths.

Figure 5:
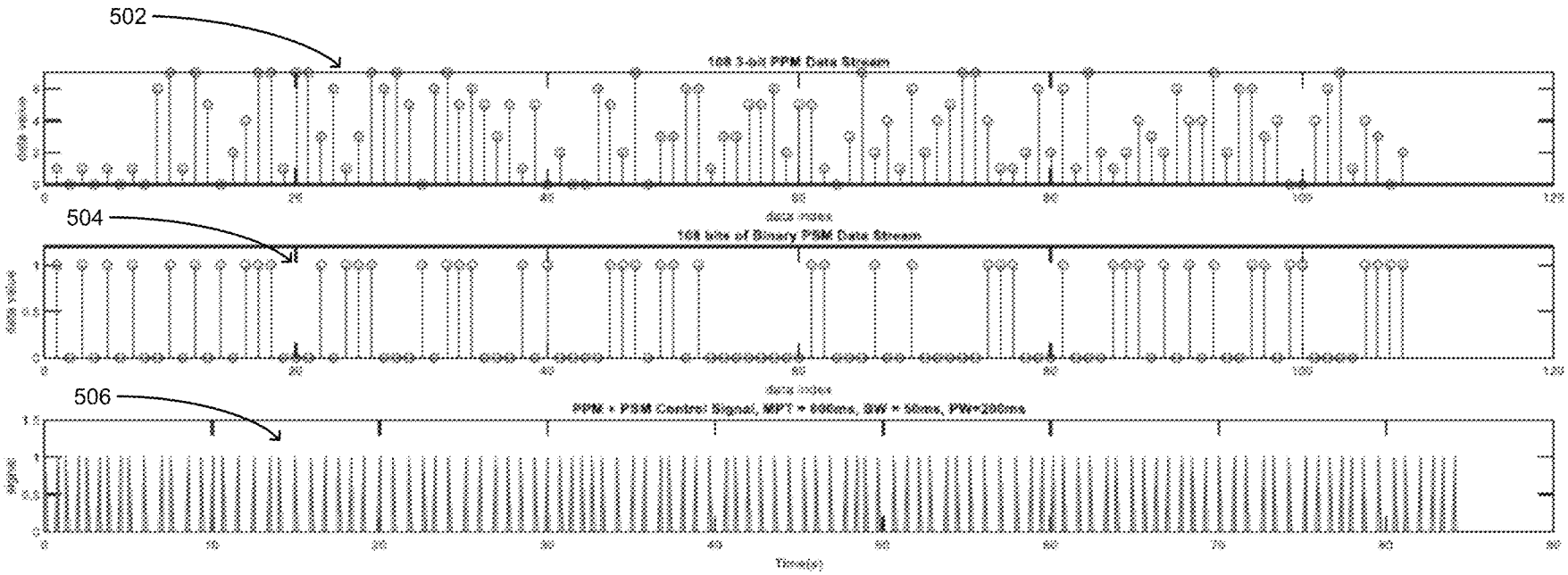
FIG. 5 illustrates a data stream divided into PPM and PSM sub-streams and a resultant combined valve control signal stream in accordance with some embodiments.

In some embodiments, PSM modulator 220 functions simultaneously with PPM modulator 218 to increase transmission data rate by encoding the data stream containing sensor data 205 using both PSM and PPM. For instance, the incoming data stream from processor 206 may be divided in an interleaved manner such as via demultiplexing performed by multiplexing and framing module 214 so that two data sub-streams are generated. One of the sub-streams is encoded by PSM modulator 220 and the other sub-stream encoded by PPM modulator 218. For instance, FIG. 5 illustrates a data stream divided into a 3-bit PPM sub-stream 502 and a PSM sub-stream 504. In some embodiments, the demultiplexing performed by multiplexing and framing module 214 comprises demultiplexing the data stream in an interleaved manner based on relative data density capacity of the pulse position modulation and the selected pulse shape modulation. The sub-streams are then reconstructively merged, such as via multiplexing performed by multiplexing and framing module 214 to assemble the encoded data symbols in the order received from processor 206.

Processor 206 communicates the sets of pulse separations for PPM encoded transmit data and the sets of pulse shapes for PSM encoded transmit data to pulse control unit 204. Pulse control unit 204 receives the encoded pulse separations and pulse shapes and based thereon induces pressure pulses in the drilling fluid within a drill string such as drill string 108. Pulse control unit 204 in accordance with at least some embodiments comprises a processor 230, a memory 232, a valve control motor 242, and a power source 238. In some embodiments, processor 230 and memory 232 may be incorporated in a microcontroller configured to send open and close signals to valve control motor 242.

Processor 220 operates in accordance with program code within memory 232, in particular a pulse control module 234, to control pulse generation in the drilling fluid. Processor 230 receives the set of pulse separation and pulse shape information from communication unit 202 across a communication link 235 that may be either a serial or parallel communication link. Pulse control unit 204 may, in bursts, receive sets of pulse separations and pulse shapes from communication unit 202 at a rate that exceeds the maximum data transmission rate. Therefore, memory 232 further includes a buffer 236 in which processor 230 may buffer queue sets of pulse separations and pulse shapes.

Figure 6:
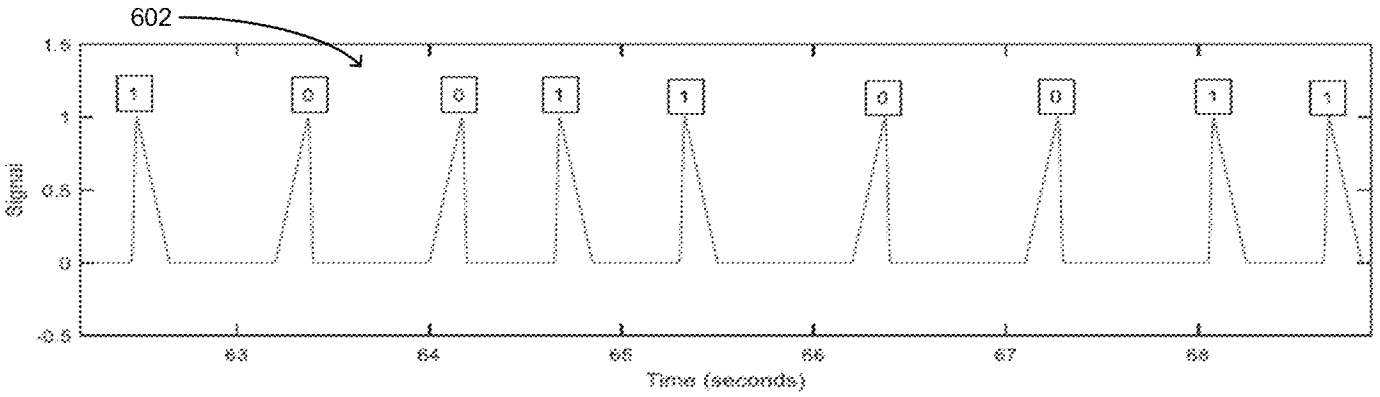
FIG. 6 depicts a zoom view of the combined valve control signals of FIG. 5 including PPM signals combined with PSM signals.

Pulse control unit 204 generates pressure pulses in the drilling fluid by controlling the open/close position of a valve 244 that controls flow of some drilling fluid. In the depicted embodiment, valve 244 is opened and closed by operation of valve control motor 242 that receives electrical power from a power source 238 such as a battery or downhole electric power generator such as a fluid-driven turbine generator. Given the high current requirements of some motors, power source 238 may further include a capacitor bank to provide sufficient surge current to valve control motor 242. Based on the stream of interleaved or otherwise combined PSM and PPM encoded instructions, processor 230 executes instruction in pulse control module 234 to generate and provide instructions to valve control motor 242 to open and close valve 244 at relative timings corresponding to pulse separations and with open/close speed determined by the respective PSM and PPM encoding instructions. For example, FIG. 5 illustrates a resultant combined valve control signal stream 506 that may be generated by pulse control unit 204. FIG. 6 depicts a zoom view of PPM signals combined with PSM signals in accordance with some embodiments. In the example shown in FIGS. 5 and 6, a 3-bit differential PPM is used where the time separation between consecutive pulses contains data values to be transmitted in accordance with the following relation:

$$\text{Time Interval Between Consecutive Pulses} = \text{MPT} + (\text{DV})(\text{BW}),$$

wherein MPT=minimum pulse time, DV=data value to be sent, and BW=bit width. For the example in FIGS. 5 and 6, MPT=600 ins, BW=50 ins, DV=3-bit value between and including 0 and $2^3-1$.

Compared to conventional PPM transmission data rate, the depicted systems that combine PPM and PSM may substantially increase telemetry transmission rate. In the example shown in FIG. 5, with pulse width=200 ms, bit width=50 ms, minimum pulse time=600 ms, the data rate (DR) of combined PPM and PSM are given by:

$DR_{PPM}$=3.87 bits per second $DR_{PSM}$=1.21 bits per second $DR_{PPM+PSM}$=5.08 bits per second, for a data rate gain of 31%.

The valve that physically creates the pressure pulses in the drilling fluid may take many forms. In some cases, the valve may create pressure pulses by temporarily restricting or blocking flow of the drilling fluid in the drill string. In situations in which the drilling fluid is restricted or blocked, an increase in drilling fluid pressure is created (i.e., a positive-pulse system). In yet still other embodiments, the valve may be configured to divert a portion of the drilling fluid out of the drill string into the borehole annulus, thus bypassing the drill bit. In situations where the drilling fluid is diverted, a decrease in drilling fluid pressure occurs (i.e., a negative-pulse system). Either positive-pulse systems or negative-pulse systems may be used in the various embodiments, so long as the transmit telemetry module 134 in combination with the valve generates sufficient pressure transitions.

Figure 8:
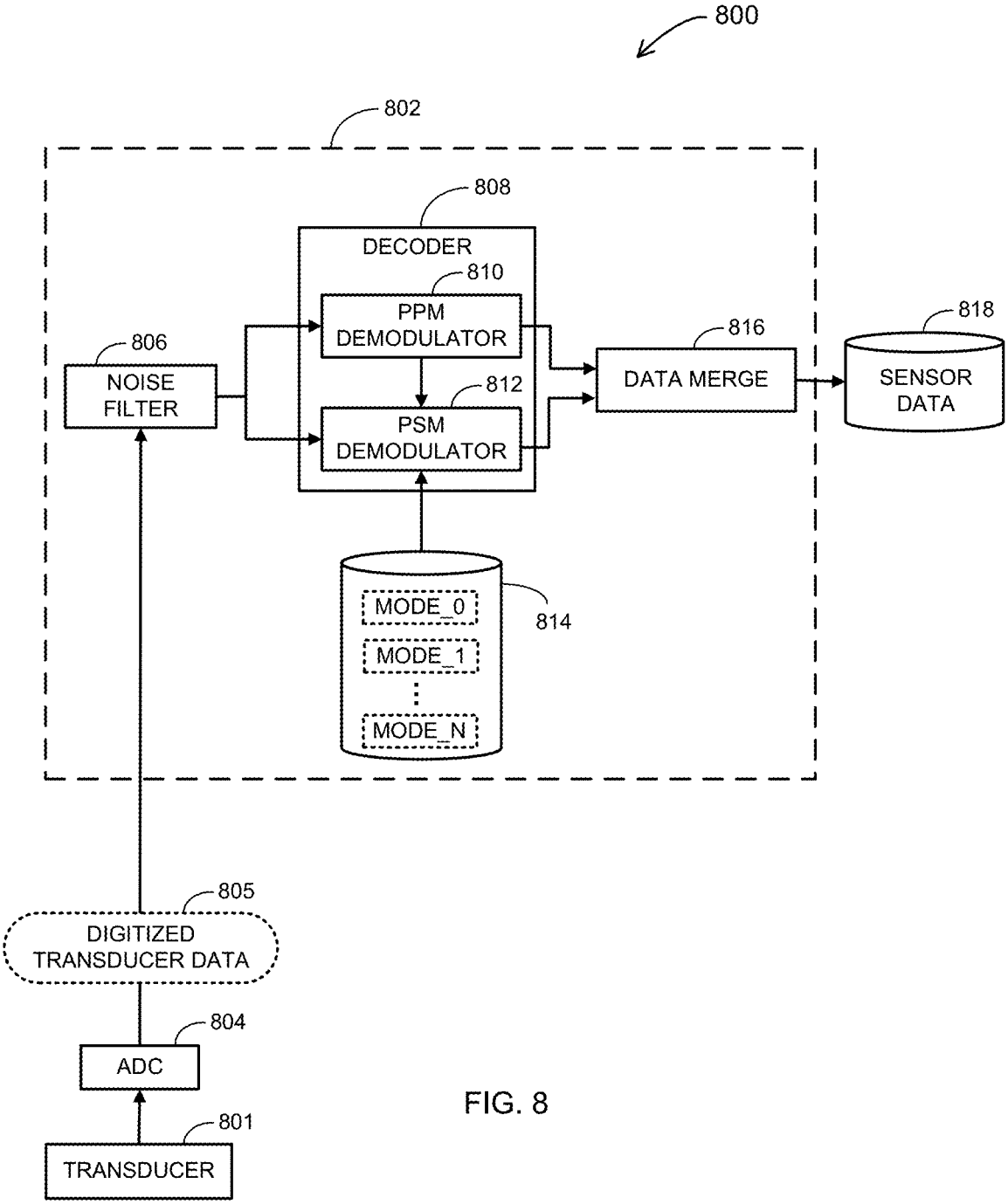
FIG. 8 depicts a receiver system in accordance with some embodiments.

FIG. 8 depicts a receiver system 800 that may be utilized in conjunction with transmitter telemetry module 200 in accordance with some embodiments. The devices and components depicted and described with reference to receiver system 800 may be implemented by the drilling system depicted in FIG. 1. Receiver system 800 includes a transducer 802 that is configured to converting incoming acoustic pressure waves into electrical signals. As depicted in FIG. 1, transducer 802 may be disposed on a standpipe or other such drilling fluid conduit in a position to detected sufficiently strong pressure pulse signals that include bi-modulated mud pulse telemetry signals that substantially increase data transmission rate. In some embodiments, the pressure pulse signals received and converted by transducer 801 include a sequence of mud telemetry encoded pulses including encoded pulse shapes. In some embodiments, the pressure pulse signals received and converted by transducer 801 include a sequence of mud telemetry encoded pulses including encoded pulse separations combined, such as in an interleaved manner, with encoded pulse shapes.

Figure 9:
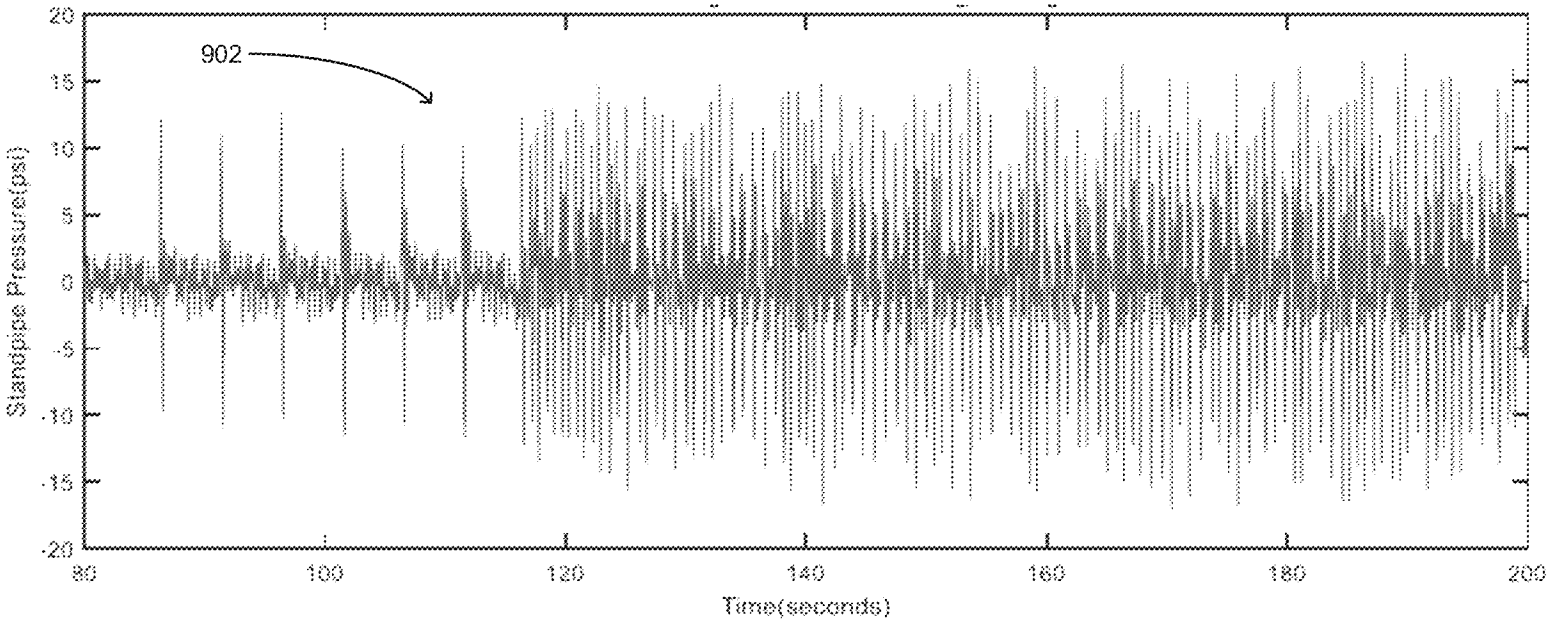
FIG. 9 illustrates received standpipe pressure signals including PPM and PSM signals in accordance with some embodiments.

For example, FIG. 9 illustrates received standpipe pressure signals including PPM and PSM signals that may be received and converted by transducer 801 in accordance with some embodiments. FIG. 9 illustrates a signal 902 resulting from a simulation performed using a 14,000 ft drill string, with a full BHA, pulser, drill bit, and two triplex mud pumps. Signal 902 represents a signal normalized with respect to hydrostatic pressure after removing pump and other drilling related noise. Drilling fluid used in the simulation has a density of 11.2 ppg, with PV of 15 cP, and flow rate of 500 gpm. FIG. 9 shows calculated standpipe pressure as a function of time when the combined PPM and PSM valve control signal in FIG. 5 is used to control the pulser motor (e.g., value motor).

Figure 10:
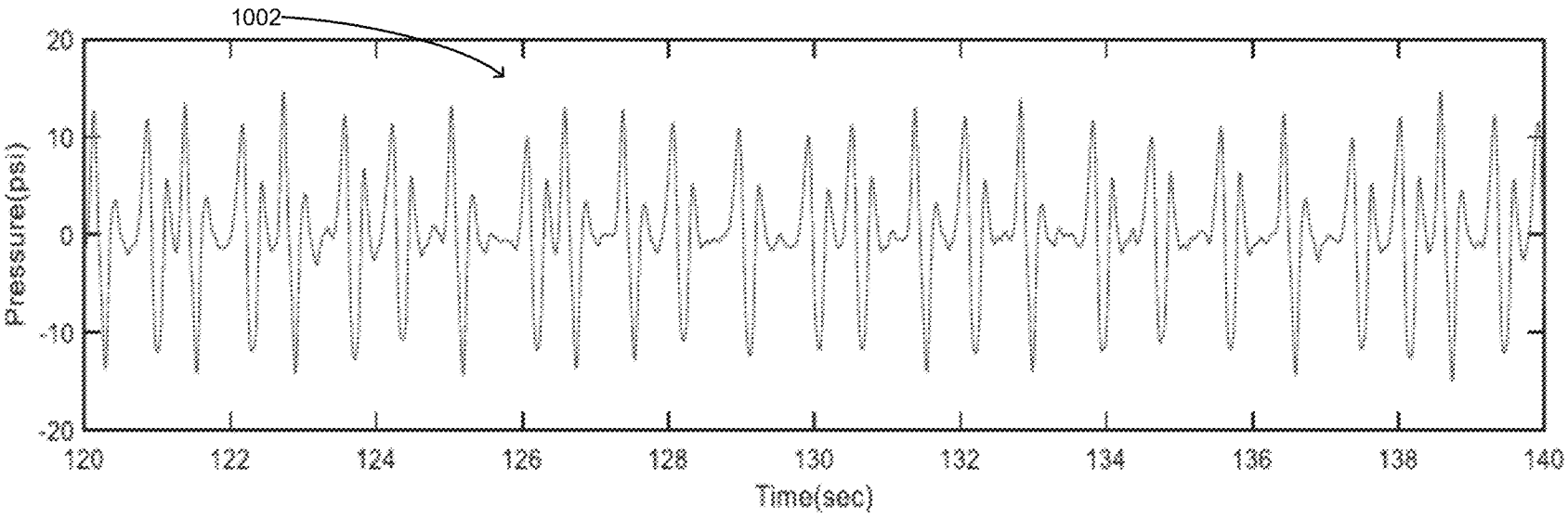
FIG. 10 depicts standpipe pressure signals after pump noise is filtered out in accordance with some embodiments.

Returning to FIG. 8, receiver system 800 further includes a digitizer 804 that receives the analog signal from transducer 801. Digitizer 804 passes the resultant stream of digitized data 805 to a receiver telemetry module 802 that includes a noise filter 806, a decoder 808, and a data merge unit 816. Initially, the digitized data stream is received and processed by noise filter 806 that is configured to remove pump noise and possibly noise from other sources. FIG. 10 depicts standpipe pressure signals after pump noise is filtered out in accordance with some embodiments. Specifically, FIG. 10 depicts a standpipe pressure data signal 1002 after pump noise is removed by noise filter 806.

Figure 11:
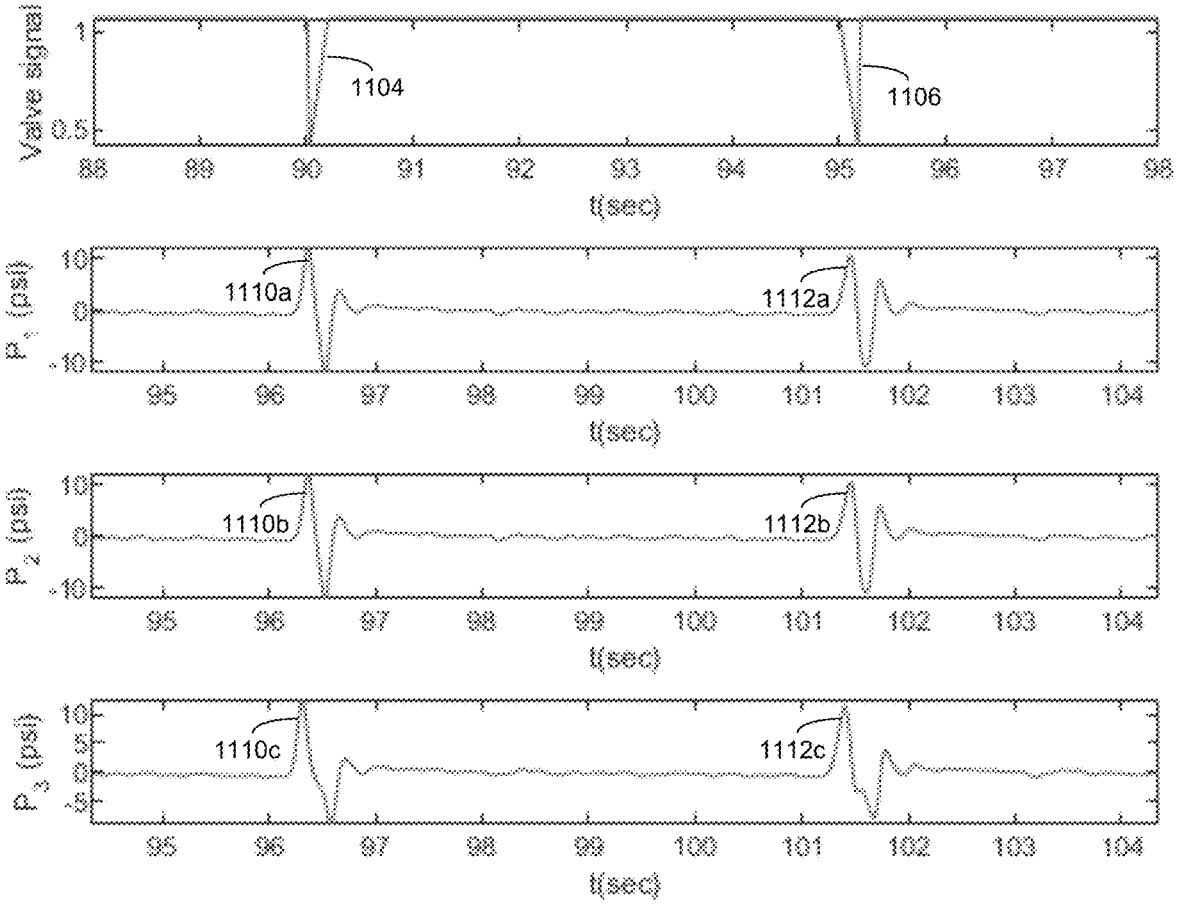
FIG. 11 illustrates valve control signals and resultant pressure signals at three different positions in accordance with some embodiments.

FIG. 11 illustrates valve control signals 1104 and 1106 and resultant pressure signals that reflect the distinct pulse shaping of PSM at three different positions in accordance with some embodiments. Valve control signal 1104 may represent a bit one value and valve control signal 1106 may represent a bit zero value. At standpipe position P1, a measured pressure pulse 1110*a* corresponds to the bit one valve control signal 1104 and a distinct measured pressure pulse signal 1112*a* corresponds to the bit zero valve control signal 1106. At standpipe position P2, a pressure pulse 1110*b* corresponds to the bit one valve control signal 1104 and a distinct measured pressure pulse signal 1112*b* corresponds to the bit zero valve control signal 1106. At standpipe position P3, a pressure pulse 1110*c* corresponds to the bit one valve control signal 1104 and a distinct measured pressure pulse signal 1112*c* corresponds to the bit zero valve control signal 1106.

Returning to FIG. 8, the digitized and filtered bi-modulated signals are received and processed by decoder 808. Decoder 808 includes a PPM demodulator 310 configured to demodulate the PPM encoded portions of the received data stream. PPM demodulator 310 is configured to detect and decode the relative spacing between consecutive pressure pulses to determine corresponding data symbols such as bits or data words. Decoder 808 further includes a PSM demodulator 812 configured to demodulate the PSM encoded portions of the received data stream by decoding the amplitude contours/shapes of individual pulses. PSM demodulator 812 includes program code and data configured to identify each of the pulse shapes associated with respective data values in accordance with the PSM encoding utilized to encode the data stream. PPM demodulator 810 and PSM demodulator 812 operates in coordination in part based on the PSM demodulation sharing the same time reference with the PPM demodulation. Being configured to identify separations between pulses, PPM demodulator 810 may be configured to synchronize PPM demodulator 812 by directly signaling the occurrences of pulses to demodulator 812.

Figure 12:
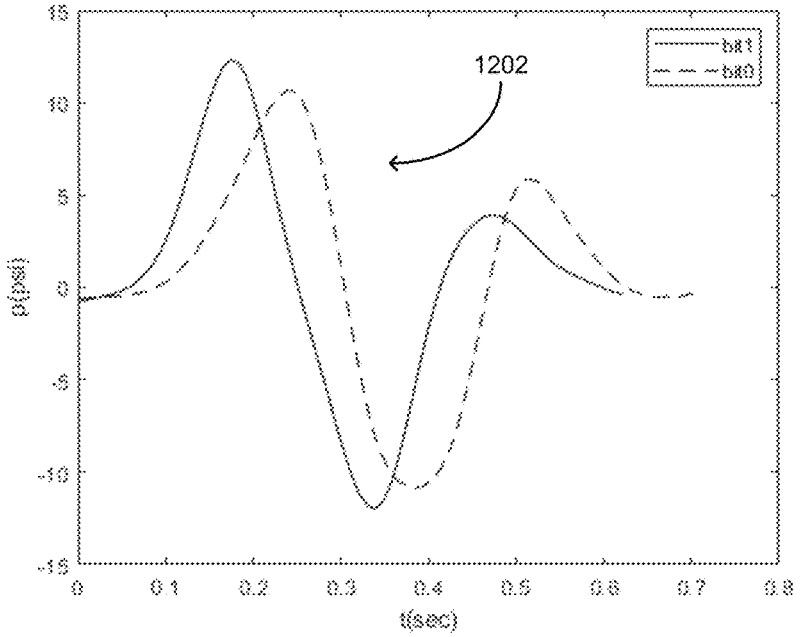
FIG. 12 depicts transposed PSM pulse shapes such as may be used for binary PSM encoding in accordance with some embodiments.

Disclosed embodiments include several different PSM demodulation procedures that may be performed by PSM demodulator 812. Instructions and data for each of the demodulation procedures is includes in a set of demodulation modules, MODE_0 through MODE_N, that are maintained within a demodulation library 814. Each of the demodulation modules may correspond to a respective one of the modulation schemas such as PS_SET1 through PS_SETN in FIG. 2. Also or alternatively, each of the demodulation modules may correspond to different demodulation techniques that may be implemented for any given PSM set. The demodulation modules are configured to enable PSM demodulator 812 to distinguish between pulse shapes based on various pulse contour characteristics. For example, FIG. 12 depicts transposed PSM pulse shapes 1202 such as may be used for binary PSM encoding and are demodulated in accordance with some embodiments. As shown, a bit 1 pulse profile shares some similarities and includes some dissimilarities with the depicted bit 0 pulse profile.

Figure 13:
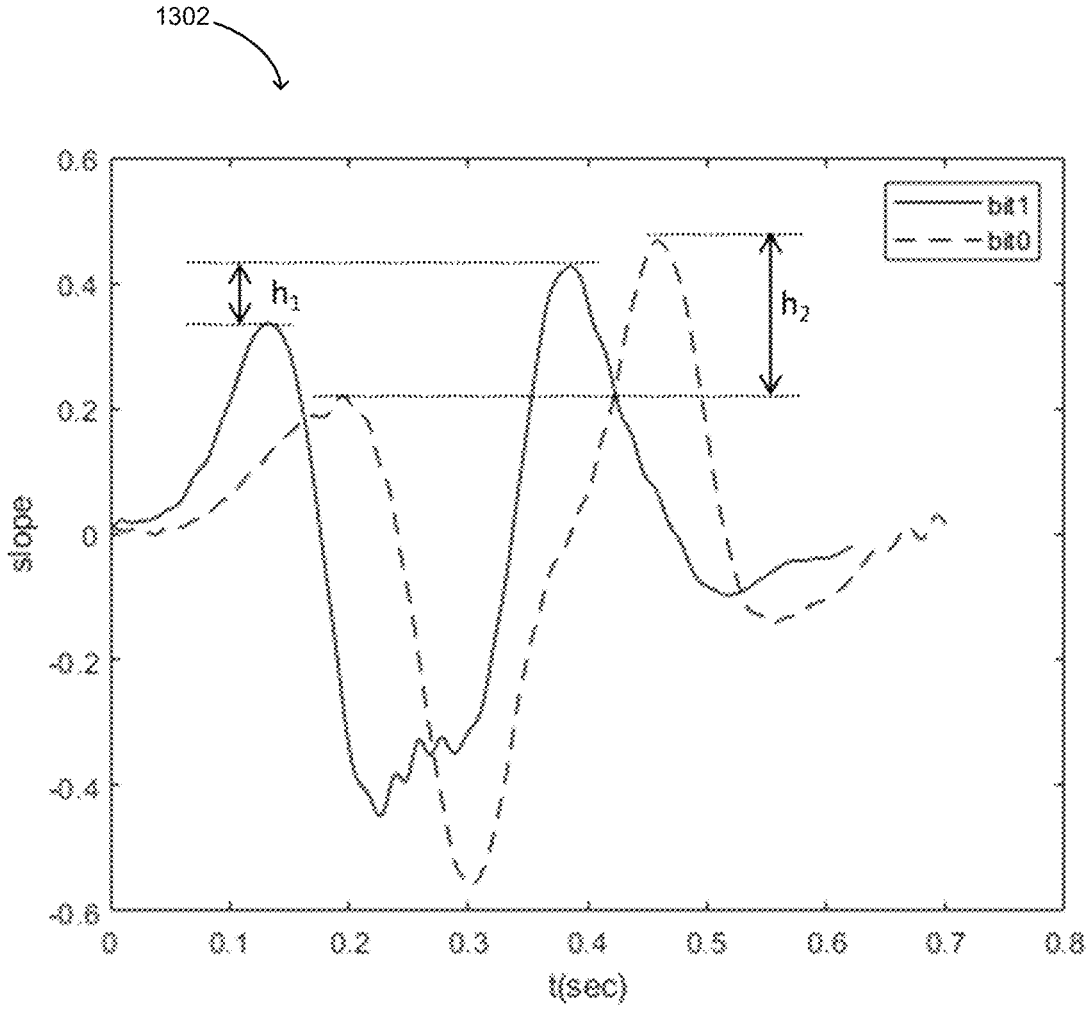
FIG. 13 illustrates time derivatives of two distinct PSM pulse shapes in accordance with some embodiments.

In some embodiments, PSM demodulator 812 implements derivative based demodulation such as by selecting and executing instructions of one of the demodulation modules. During derivative based demodulation, PSM demodulator 812 continuously monitors the pressure pulse data such as in FIG. 12 in which each of the bit 1 and bit 0 pulses have two maxima in respective derivatives of each. FIG. 13 illustrates time derivatives of two distinct PSM pulse shapes 1302 corresponding to bit 1 and bit 0 in which $h_1$ and $h_2$ represent the separations between the maxima (peaks) of each profile. A key distinguishing feature is the substantial difference in magnitude between $h_1$ and $h_2$ in which $h_2 >> h_1$. This difference in maxima is computed and utilized to decode the shape of each pulse and extract the PSM binary data by using the following method. After calculating the time derivative for representative data symbols (e.g., bit 1 and bit 0), PSM demodulator 812 determines the maxima for each. PSM demodulator 812 determines the separation, h, based on the maxima and determines a threshold separation, h, value that may be utilized during runtime demodulation. During runtime demodulation, PSM demodulator 812 compares the separation with the threshold separation value to determine whether the pulse is a bit 1 or a bit 0 or possibly other data symbol. For instance, in response to determining that a currently determined maxima separation value is less than the threshold, PSM demodulator 812 may determine that the corresponding pulse represents a bit 1, or else it represents a bit 0.

Figure 14:
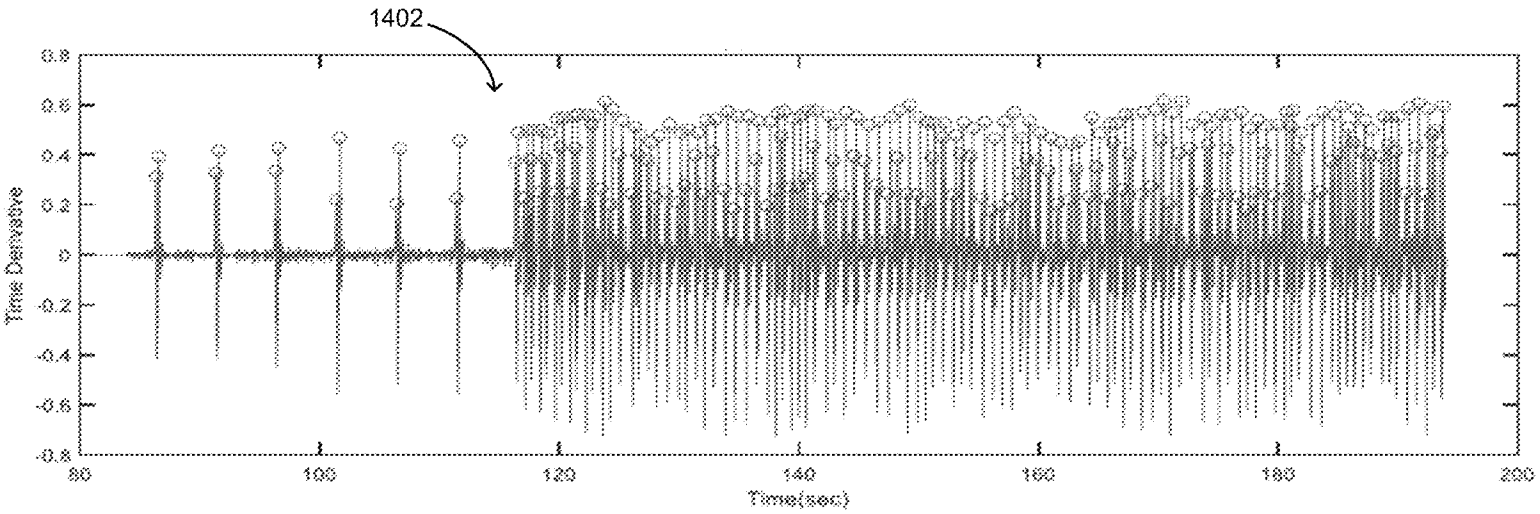
FIG. 14 depicts peak detection in time derivative data such as performed by a PSM demodulator in accordance with some embodiments.
Figure 15:
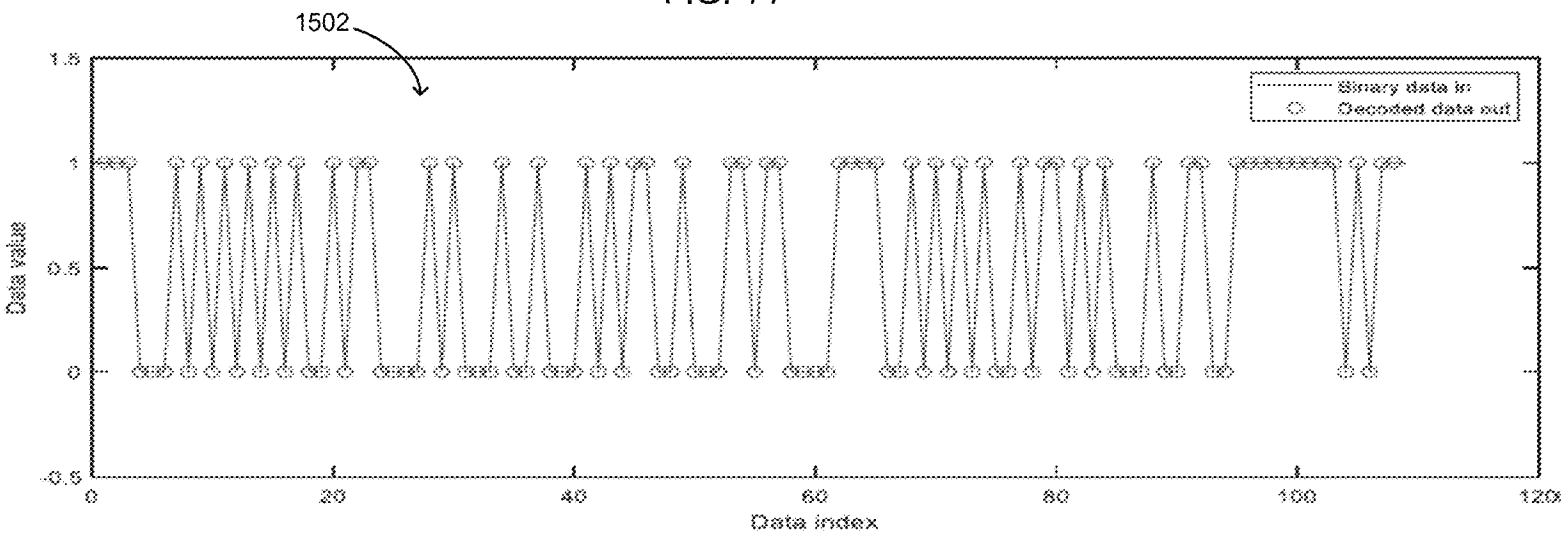
FIG. 15 illustrates derivative algorithm output generated by a PSM demodulator in accordance with some embodiments.

For the simulated standpipe pressure data shown in FIG. 9, this method and its efficacy are shown in FIGS. 14 and 15.

FIG. 14 depicts peak/maxima detection in time derivative data 1402 such as may be performed by PSM demodulator 812 in which the respective peaks of binary PSM encoded data are shown as circled. FIG. 15 illustrates derivative algorithm output 1502 such as may be generated by PSM demodulator 812 in which the input binary data is represented by lines and the decoded output data represented as circles.

In some embodiments, PSM demodulator 812 implements cross-correlation demodulation such as by selecting and executing instructions of one of the demodulation modules to decode amplitude contours of each of the detected pressure pulses. Cross-correlation demodulation comprises cross-correlating the amplitude contours of each of the detected pressure pulses with stored pulse contours corresponding to data symbols.

Cross-correlating the amplitude contours of each of the detected pressure pulses with the stored pulse contours includes generating and executing a matching function to determine correlation curves for each of the stored pulse contours across a set of the detected pressure pulses. Cross-correlating the amplitude contour further includes determining peak values for each of the correlation curves and determining data symbols for each of the detected pressure pulses based on comparing the peak values for each of the correlation curves.

Figure 16:
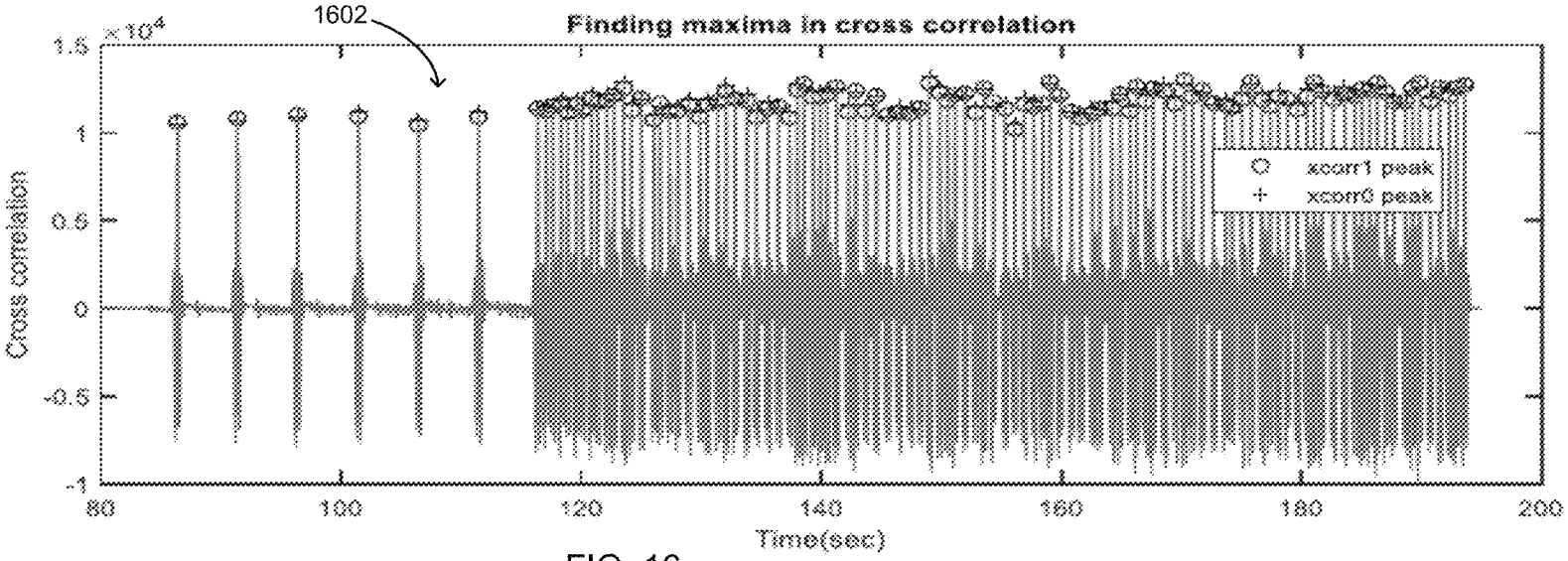
FIG. 16 depicts cross-correlation demodulation data generated by a PSM demodulator in accordance with some embodiments.

For example, cross-correlation demodulation may comprise building matching functions by using known data sequences (e.g., sequences of known bit 1 and bit 0 pulses) to build a bit profile template for each shape used for a PSM set. In this manner, PSM demodulator 812 cross-correlates each runtime pulse profile with one or more of the bit profile templates until a close enough match is determined and the data symbol decoded accordingly. During cross-correlation demodulation, PSM demodulator 812 implements a cross-correlation comparison of the input data such as maxima/peak comparison. For single bit binary PSM, PSM demodulator 812 cross-correlates the input data with each stored profile template to generate xcorr1 data corresponding to bit 1 and xcorr0 data corresponding to bit 0. PSM demodulator 812 then determines the maxima (peaks) of the xcorr1 and xcorr0 data, $xcorr1_{max}$ and $xcorr0_{max}$. For each peak, PSM demodulator 812 determines whether the corresponding $xcorr1_{max}$ value is greater than or less than the corresponding $xcorr0_{max}$ value. If greater than one, PSM demodulator 812 identifies the corresponding bit pulse as a bit 1, or if not as a bit 0. For the simulated standpipe pressure data shown in FIG. 9, the $xcorr1_{max}$ and $xcorr0_{max}$ determination is shown in FIG. 16, which depicts cross-correlation data as may be generated by PSM demodulator 812.

Figure 17:
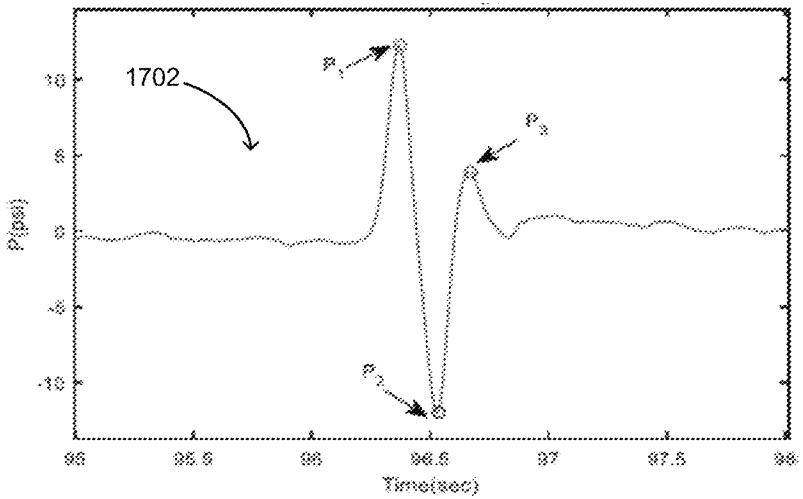
FIG. 17 illustrates an example pulse signal that may be detected and demodulated using peak-to-peak over trailing peak demodulation in accordance with some embodiments.

In some embodiments, PSM demodulator 812 implements demodulation using peak-to-peak over trailing peak ratio such as by selecting and executing instructions of one of the demodulation modules. FIG. 17 illustrates an example pulse signal that may be detected and demodulated using peak-to-peak over trailing peak demodulation in accordance with some embodiments. As shown in FIG. 17, a representative pulse signal profile 1702 includes a positive peak P1, a negative peak or minima peak P2, and a trailing peak, P3. During demodulation, PSM demodulator 812 calculates or otherwise determines a peak-to-peak over trailing peak ratio, k, in accordance with the following relation:

$$k = \frac{P1 - P2}{P3} = \frac{P1 + |P2|}{P3}.$$

Figure 18:
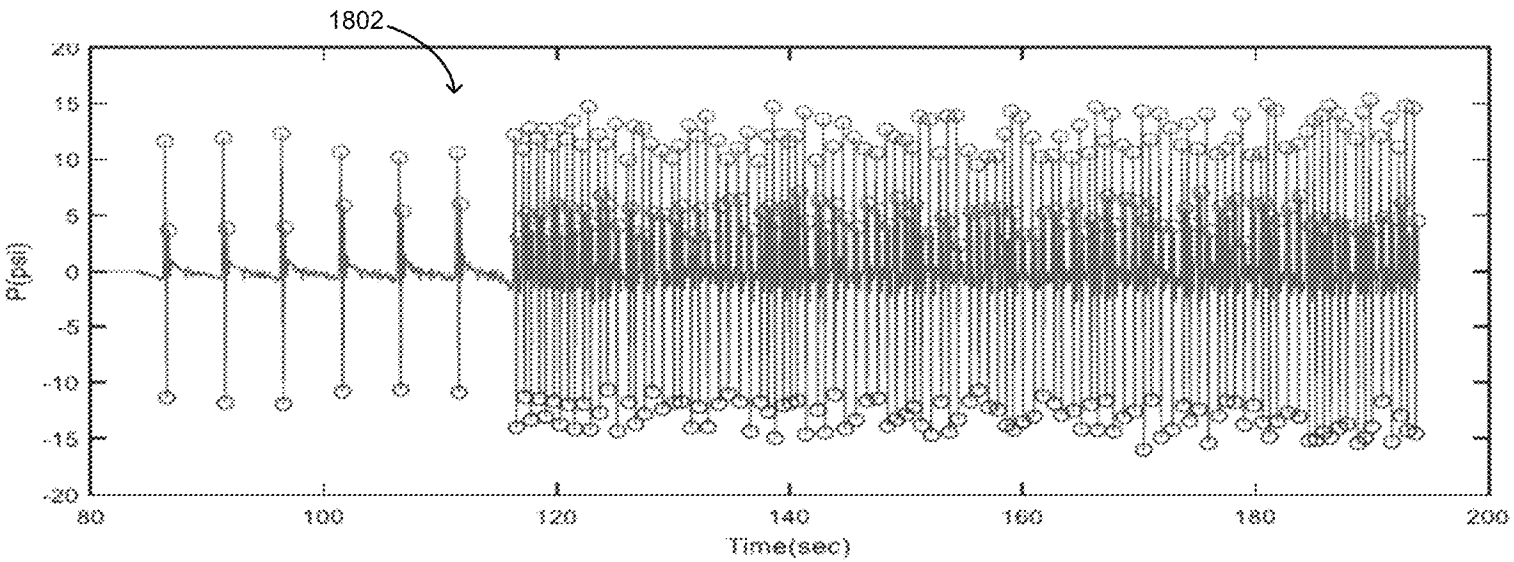
FIG. 18 depicts identification of max, min, and trailing peaks by a PSM demodulator in accordance with some embodiments.
Figure 19:
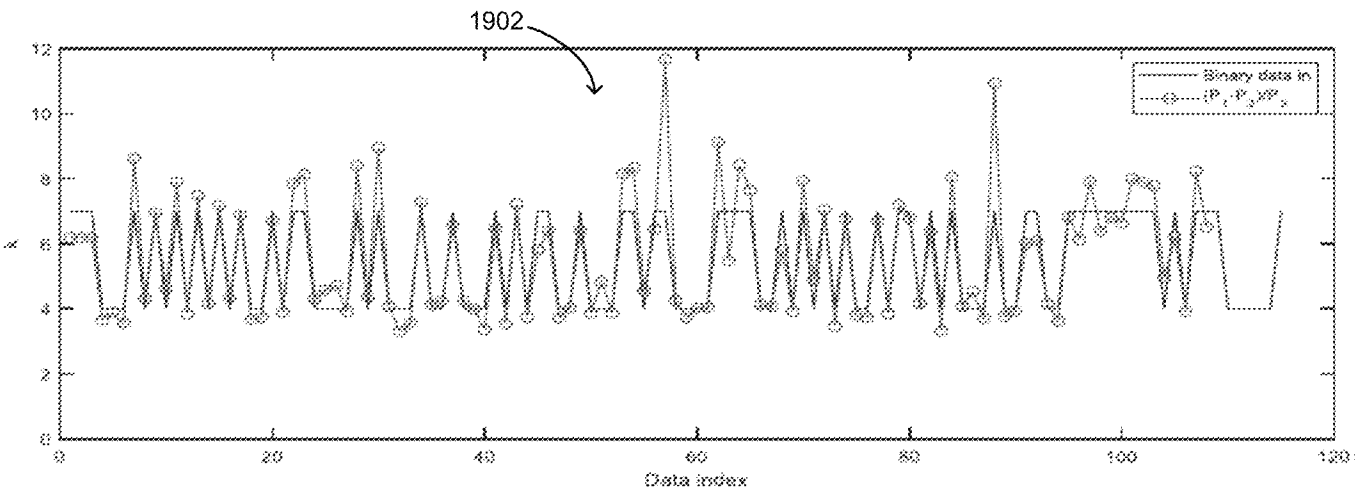
FIG. 19 illustrates correlation between peak-to-peak over trailing peak ratio such as may be performed by a PSM demodulator in accordance with some embodiments.

Values of k tend to cluster around two distinct values that correspond to the two distinct pulse shapes for single bit PSM. Peak-to-peak over trailing peak demodulation begins with demodulator 812 using a peak finder or other tool to identify the major maxima P1, minima P2, and minor maxima P3 for each pulse. For each pulse, PSM demodulator 812 calculates a k value based on the P1, P2, and P3 values and compares each of the k values with a threshold k value to determine whether each pulse is a bit 1 or bit 0. For example, in response to determining that a k value for a given pulse exceeds the threshold, PSM demodulator 812 may determine that the corresponding bit is bit 1, and otherwise bit 0. FIGS. 18 and 19 illustrate this method as applied to the simulation data depicted in FIG. 9 in which using a threshold k value of 5, this method accurately recovers all bit in the transmitted bit stream. Specifically, FIG. 18 depicts identification of max, min, and trailing peaks of pulse data 1802 and FIG. 19 depicts correlation data 1902 between k values and the PSM data stream with the threshold k set to 5.

Figure 20:
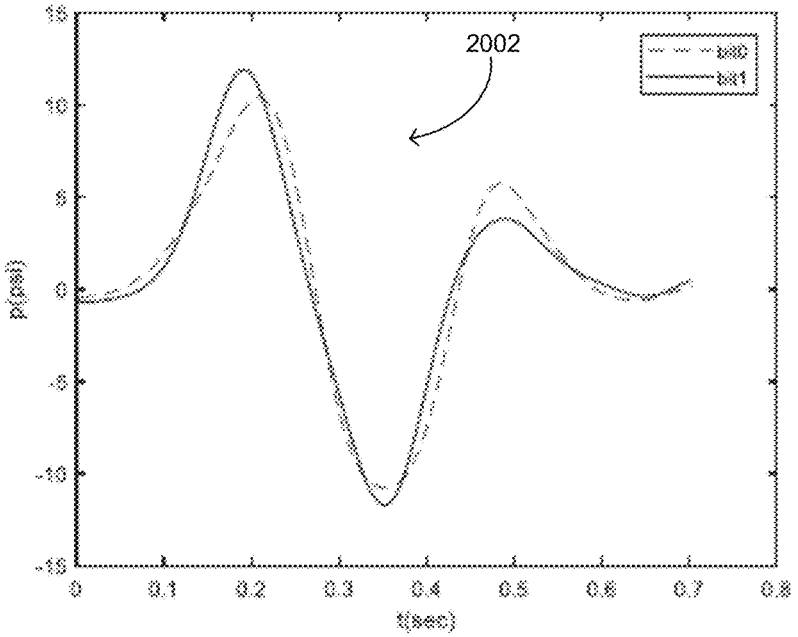
FIG. 20 depicts profiles of two distinct PSM pulse shapes detected by a receiver in accordance with some embodiments.
Figure 21:
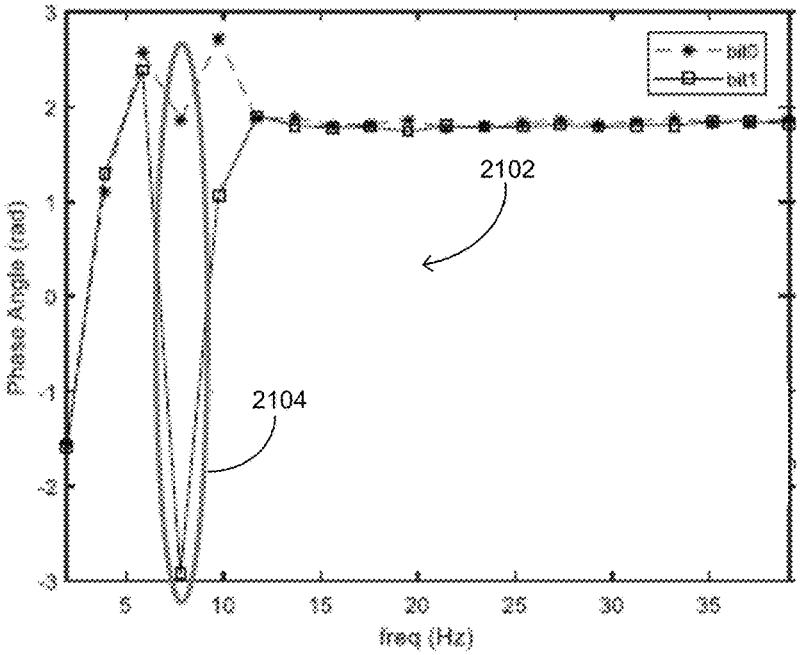
FIG. 21 illustrates corresponding phase information for pulses shown in FIG. 20 such as may be determined by a PSM demodulator in accordance with some embodiments.

In some embodiments, PSM demodulator 812 implements phase detection demodulation such as by selecting and executing instructions of one of the demodulation modules. When operating in this mode, PSM demodulator 812 generates a frequency domain representation of the detected pressure pulses for each of the frequency domain representations of the detected pressure pulses and calculates a phase value at a specified frequency value or frequency bin. PSM demodulator 812 uses the variation in phase from a frequency bin that is identified to exhibit distinct phase difference between a bit 1 pulse and a bit 0 pulse as shown in FIGS. 20 and 21. FIG. 20 depicts profiles of two distinct PSM pulse shapes 2002 as measured on a standpipe and including distinct phase information. FIG. 21 illustrates corresponding phase information for pulses shown in FIG. 20 such as may be determined by a PSM demodulator. As shown in FIGS. 20 and 21, the largest phase difference occurs at a frequency bin 2104 centered at 7.8 Hz.

Figure 22:
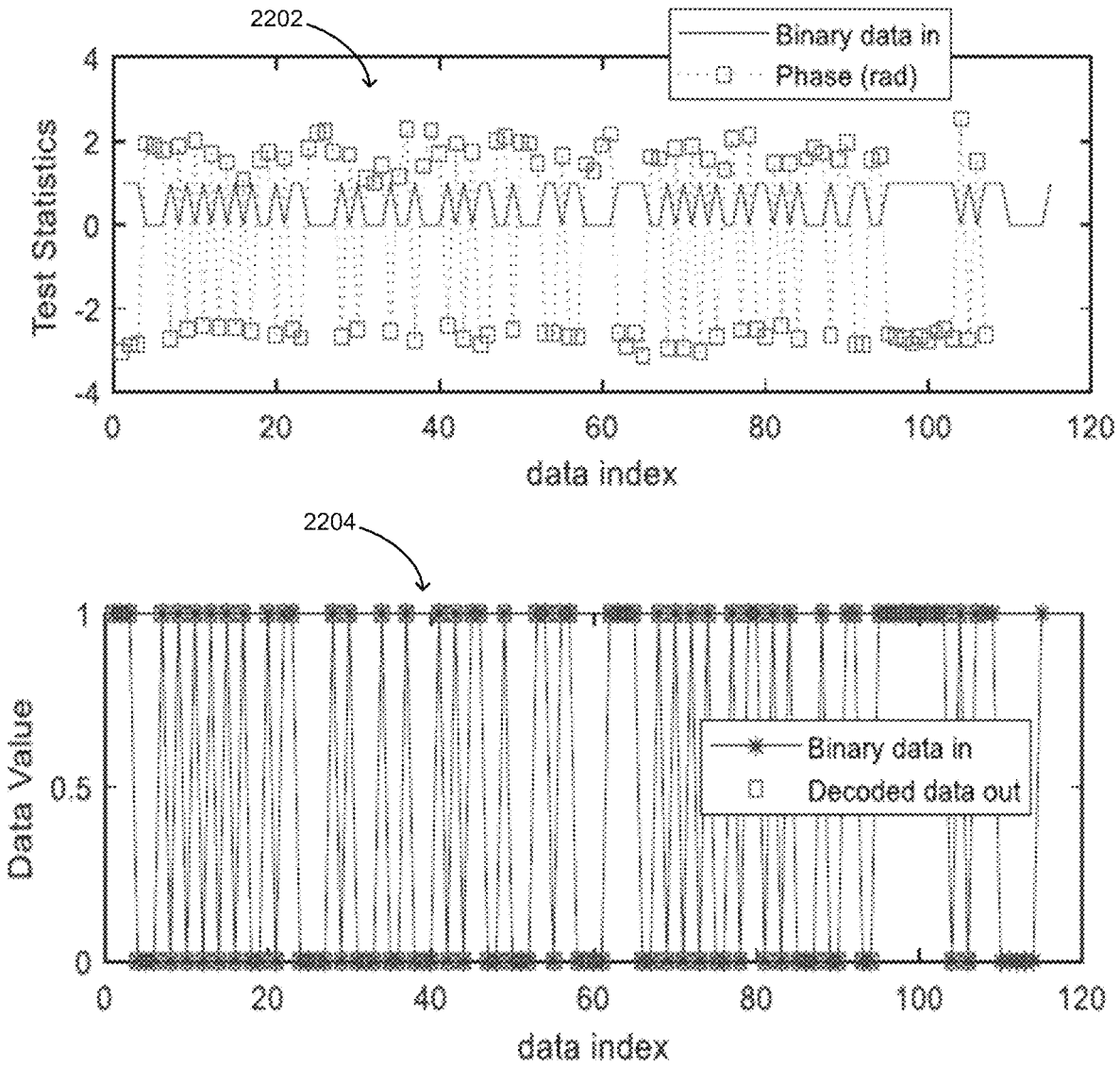
FIG. 22 depicts efficacy of a phase detection algorithm in accordance with test statistics and corresponding measured data relating data in and decoded data out.

Once the frequency bin or single frequency that exhibits the largest phase difference is identified, PSM demodulator may execute a detection mechanism to decode bit 0 and bit 1 from the corresponding pulse. The depicted simulation in FIGS. 20 and 21 shows that the phase at 7.8 Hz of bit 0 is 1.86 radians while that at bit 1 is −2.9211 radians, resulting in a usable pattern in which bit 0 is expected to have positive phase while bit is expected to have negative phase. To implement this method, PSM demodulator 812 calculates an N-point Fast Fourier Transform (FFT) for the pressure pulse waveform. PSM demodulator 812 then calculates phase value(s) at the frequency (e.g., 7.8 Hz) at which the largest phase difference between bit 1 and bit 0 was determined to occur. PSM demodulator 812 then compares the calculated phase value with a phase threshold (e.g., zero) to determine whether the pulse corresponds to a bit 1 or bit 0. For example, if the calculated phase is greater than the phase threshold, PPM demodulator 812 may identify the corresponding bit as bit 0, and otherwise bit 1. FIG. 22 depicts efficacy of a phase detection algorithm in accordance with test statistics and corresponding measured data relating data in and decoded data out. Specifically, FIG. 22 illustrates a test statistics data 2202 a correlation between binary data in and corresponding phase values. FIG. 22 further depicts data curve 2204 showing the accuracy of the demodulation in which known data values correspond exactly demodulated data.

Following PSM demodulation by one or more of the disclosed methods and PPM demodulation, data merge unit 816 merges a first sub-stream of PPM decoded data with the second sub-stream of PSM decoded data such as via multiplexing. The merged data may then be transmitted and stored in a sensor data repository 818.

Figure 23:
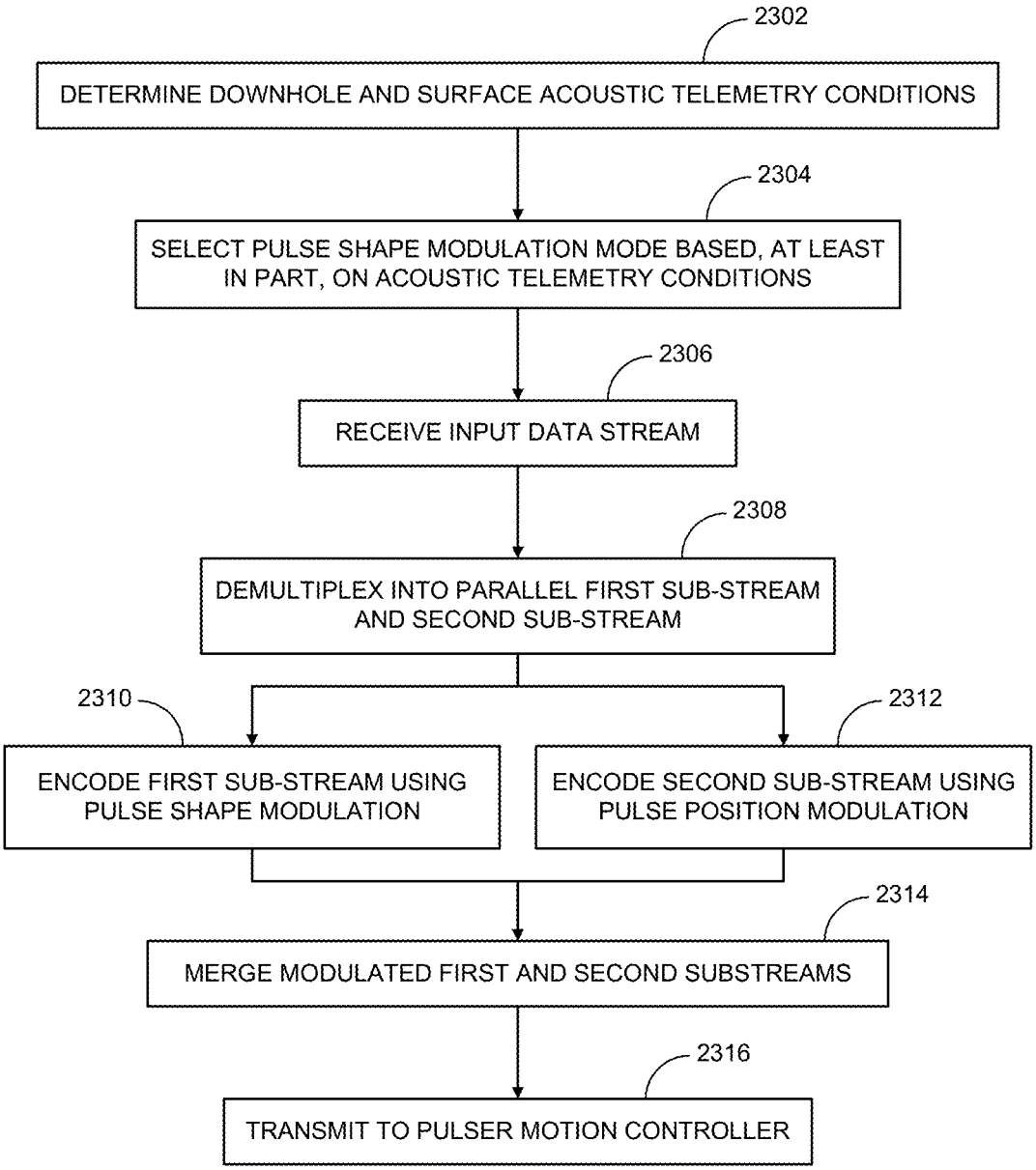
FIG. 23 is a flow diagram depicting operations and functions for generating and transmitting bi-modulated mud pulse telemetry signals in accordance with some embodiments.

FIG. 23 is a flow diagram depicting operations and functions for generating and transmitting bi-modulated mud pulse telemetry signals in accordance with some embodiments. The operations and functions depicted and described with reference to FIG. 23 may be implemented by the systems, devices, and components depicted and described with reference to FIGS. 1 and 2. The process begins as shown at block 2302 with downhole and/or surface measurement tools such as downhole tools 132 detecting and measuring or otherwise determining downhole and/or surface acoustic conditions. The measurement tool data may be provided to a telemetry controller such as a transmitter telemetry module. At block 2304, programmed components such as a channel coding module within the transmitter telemetry module selects a PSM mode based, at least in part, on downhole or surface acoustic conditions as determined by the measurement data. For example, in response to determining a lower noise environment the channel coding module may select a PSM mode having a larger PSM pulse shape set to enable denser encoding.

At block 2306, the transmitter telemetry module receives an input data stream comprising binary measurement data such as may be collected by downhole measurement tools. The telemetry module divides the input data stream, such as by demultiplexing, into two data sub-streams that are mutually interleaved (block 2308). The telemetry module encodes the first sub-steam using PPM (block 2310) and encodes the second sub-stream using PSM (block 2312). At block 2314, the telemetry module merges, such as via multiplexing, the PPM encoded first sub-stream and the PSM encoded second sub-stream to regenerate the original data sequence. The merged, bi-modulated data stream is then transmitted to a pulser motion controller such as a valve position controller to determine the timing and separation of pressure pulses and the shapes of the pressure pulses as shown at block 2316.

Figure 24:
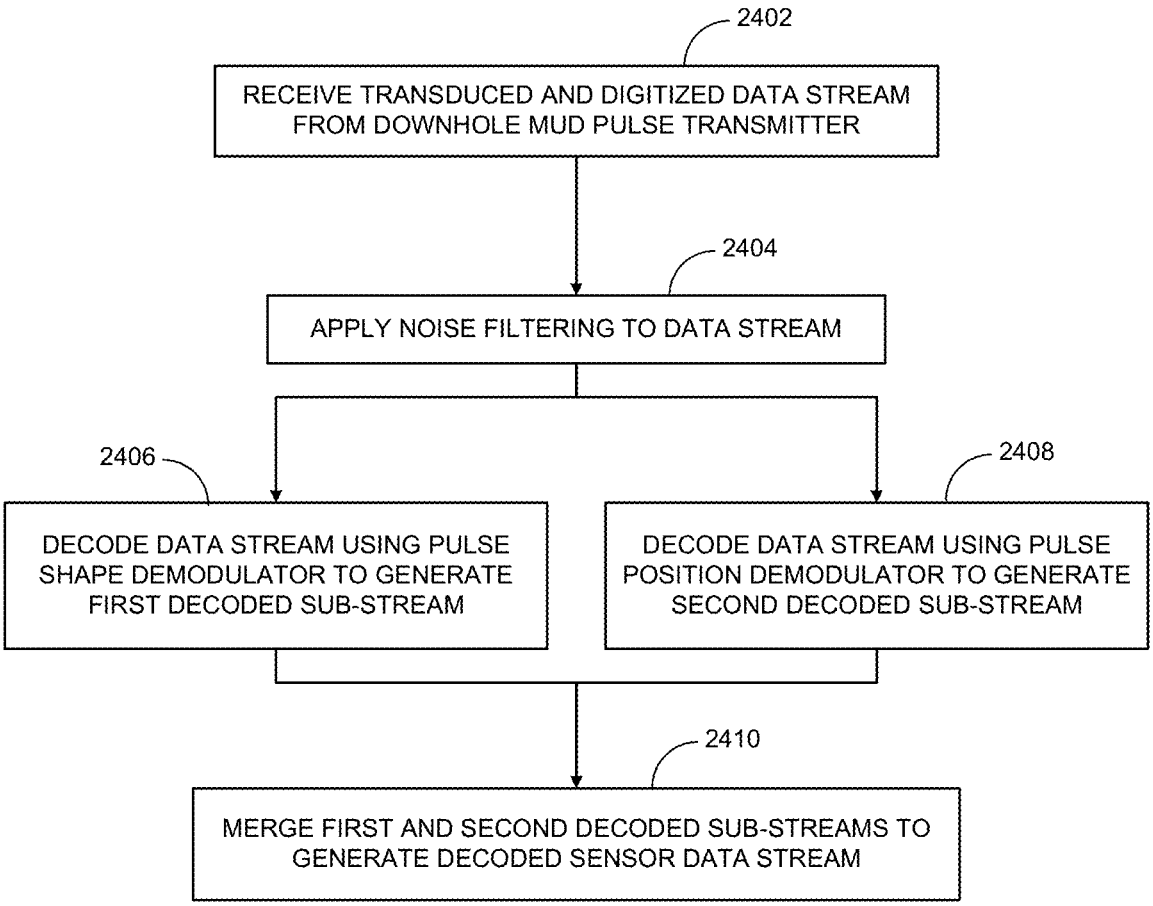
FIG. 24 is a flow diagram illustrating operations and functions for receiving and decoding bi-modulated mud pulse telemetry signals in accordance with some embodiments.

FIG. 24 is a flow diagram illustrating operations and functions for receiving and decoding bi-modulated mud pulse telemetry signals in accordance with some embodiments. The operations and functions depicted and described with reference to FIG. 24 may be implemented by the systems, devices, and components depicted and described with reference to FIGS. 1 and 8. The process begins as shown at block 2402 with a receiver telemetry module receiving transduced and digitized data from a downhole mud pulse transmitter. At block 2404, the receiver telemetry module applies a noise filter to remove acoustic noise interference such as surface pump noise. The data stream may be real-time streamed or may be buffered and provided as input to a PPM demodulator and a PSM demodulator within the receiver telemetry module. At block 2406, the PSM demodulator decodes the pulses within the data stream to generate a first decoded sub-stream. At block 2408, the PPM demodulator decodes the separations between the pulses to generate a second decoded sub-stream. The process for a given data window ends at block 2410 with the receiver telemetry module merging, such as by multiplexing the decoded sub-streams to generate the original sequence of data in decoded form.

While the methods in FIGS. 23 and 24, transmitter telemetry module 200, and receiver system 800 are described as implementing mud pulse telemetry, some of the described components and operations may be implemented by telemetry systems using other transmission media and signal types such as electromagnetic and optical telemetry systems.

Example Computer

Figure 25:
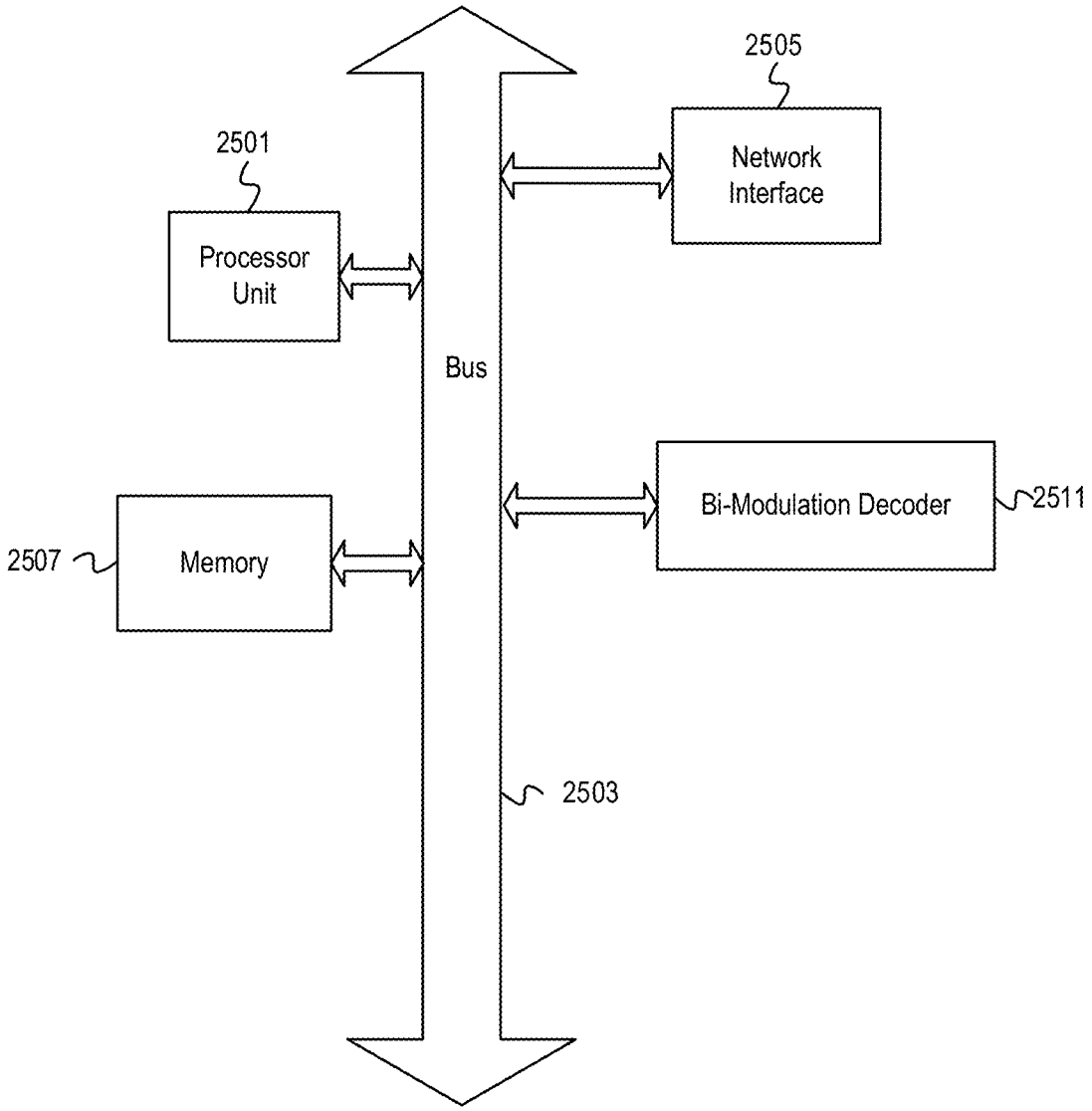
FIG. 25 depicts a computer system configured to decode bi-modulated mud pulse telemetry signals in accordance with some embodiments.

FIG. 25 is a block diagram depicting an example computer system that may be utilized to implement PSM demodulation in accordance with some embodiments. The computer system includes a processor 2501 possibly including multiple processors, multiple cores, multiple nodes, and/or implementing multi-threading, etc. The computer system includes a memory 2507. The memory 2507 may be system memory (e.g., one or more of cache, SRAM, DRAM, etc.) or any one or more of the above already described possible realizations of machine-readable media. The computer system also includes a bus 2503 (e.g., PCI, ISA, PCI-Express, InfiniBand® bus, NuBus, etc.) and a network interface 2505 which may comprise a Fiber Channel, Ethernet interface, SONET, or other interface.

The system also includes a bi-modulation decoder 2511, which may comprise hardware, software, firmware, or a combination thereof. Bi-modulation decoder 2511 may be configured similarly to DPS 150 in FIG. 1 and/or receiver telemetry module 802 in FIG. 8. Any one of the previously described functionalities may be partially (or entirely) implemented in hardware and/or on the processor 2501. For example, the functionality may be implemented with an application specific integrated circuit, in logic implemented in the processor 2501, in a co-processor on a peripheral device or card, etc.

Variations

While the aspects of the disclosure are described with reference to various implementations and exploitations, it will be understood that these aspects are illustrative and that the scope of the claims is not limited to them. In general, techniques for implementing data encoding and decoding as described herein may be performed with facilities consistent with any hardware system or systems. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. Use of the phrase "at least one of" preceding a list with the conjunction "and" should not be treated as an exclusive list and should not be construed as a list of categories with one item from each category, unless specifically stated otherwise.

Example Embodiments

Embodiment 1: A downhole telemetry method comprising driving a pulser device based on an input data stream, wherein driving the pulser device includes generating modulated pressure pulses including modulated pulse shapes within a fluid telemetry medium. The pulser device may comprise a valve and a valve controller configured to open and close the valve, and wherein said driving the pulser device may comprise generating a valve control signal that encodes one or more pulses shapes corresponding to valve open or close signals; and applying the valve control signal to the valve controller. The modulated pulse shapes may correspond to two or more amplitude contours, and said method may further comprise detecting pressure pulses transmitted across the fluid telemetry medium; and demodulating the modulated pressure pulses by decoding amplitude contours of each of the detected pressure pulses. The decoding amplitude contours of each of the detected pressure pulses may comprise computing time derivatives of the amplitude contours; and for each time derivative, determining at least one of a maxima differential or a minima differential; and decoding a corresponding data symbol based on the at least one of a maxima differential or minima differential. Decoding amplitude contours of each of the detected pressure pulses may comprise cross-correlating the amplitude contours of each of the detected pressure pulses with stored pulse contours corresponding to data symbols. Said cross-correlating the amplitude contours of each of the detected pressure pulses with the stored pulse contours may include executing a matching function to determine correlation curves for each of the stored pulse contours across a set of the detected pressure pulses; determining peak values for each of the correlation curves; and determining data symbols for each of the detected pressure pulses based on comparing the peak values for each of the correlation curves. Decoding amplitude contours of each of the detected pressure pulses may comprises, for each of the detected pressure pulses, determining maxima, minima, and trailing peaks; calculating a peak-to-peak over trailing peak ratio based on the determined maxima, minima, and trailing peaks; and determining a data symbol based on comparison of the determined peak-to-peak over trailing peak ratio with a threshold value. Decoding amplitude contours of each of the detected pressure pulses may comprise generating a frequency domain representation of the detected pressure pulses; and for each of the frequency domain representations of the detected pressure pulses, calculating a phase value at a specified frequency value or frequency bin; and determining a data symbol based on comparison of the calculated phase value with a threshold value. Driving the pulser device may further comprise modulating pressure pulses including pulse position modulating pressure pulses. Said pulse position modulating may comprise modulating separations between pressure pulses. The method may further comprise receiving a data stream; dividing the data stream into a first sub-stream and a second sub-stream; and wherein said generating modulated pressure pulses may comprise, modulating the first sub-stream using pulse shape modulation; and modulating the second sub-stream using pulse position modulation. Said dividing the data stream may comprise demultiplexing the data stream in an interleaved manner based on relative data density capacity of the pulse shape modulation and the pulse position modulation.

Embodiment 2: A fluid telemetry system comprising: a pulser device; and a control system for driving the pulser device based on an input data stream, wherein driving the pulser device includes generating modulated pressure pulses including modulated pulse shapes within a fluid telemetry medium. The pulser device may comprise a valve and a valve controller configured to open and close the valve, and said driving the pulser device may comprise generating a valve control signal that encodes one or more pulses shapes corresponding to valve open or close signals; and applying the valve control signal to the valve controller. The modulated pulse shapes may correspond to two or more amplitude contours, and said fluid telemetry system may further comprise a receiver configured to detect pressure pulses transmitted across the fluid telemetry medium; and a decoder configured to demodulate the modulated pressure pulses by decoding amplitude contours of each of the detected pressure pulses. Decoding amplitude contours of each of the detected pressure pulses may comprise computing time derivatives of the amplitude contours; and for each time derivative, determining at least one of a maxima differential or a minima differential; and decoding a corresponding data symbol based on the at least one of a maxima differential or minima differential. Decoding amplitude contours of each of the detected pressure pulses may comprise cross-correlating the amplitude contours of each of the detected pressure pulses with stored pulse contours corresponding to data symbols. Said cross-correlating the amplitude contours of each of the detected pressure pulses with the stored pulse contours may include executing a matching function to determine correlation curves for each of the stored pulse contours across a set of the detected pressure pulses; determining peak values for each of the correlation curves; and determining data symbols for each of the detected pressure pulses based on comparing the peak values for each of the correlation curves. Decoding amplitude contours of each of the detected pressure pulses may comprise for each of the detected pressure pulses, determining maxima, minima, and trailing peaks; calculating a peak-to-peak over trailing peak ratio based on the determined maxima, minima, and trailing peaks; and determining a data symbol based on comparison of the determined peak-to-peak over trailing peak ratio with a threshold value. Decoding amplitude contours of each of the detected pressure pulses may comprise generating a frequency domain representation of the detected pressure pulses; and for each of the frequency domain representations of the detected pressure pulses, calculating a phase value at a specified frequency value or frequency bin; and determining a data symbol based on comparison of the calculated phase value with a threshold value. Driving the pulser device may further comprise modulating pressure pulses including pulse position modulating pressure pulses. Said pulse position modulating may comprise modulating separations between pressure pulses. The fluid telemetry system may further comprise a receiver telemetry module configured to receive a data stream; and divide the data stream into a first sub-stream and a second sub-stream. Generating modulated pressure pulses may comprise modulating the first sub-stream using pulse shape modulation; and modulating the second sub-stream using pulse position modulation. Said dividing the data stream may comprise demultiplexing the data stream in an interleaved manner based on relative data density capacity of the pulse shape modulation and the pulse position modulation.

What is claimed is:

1. A downhole telemetry method comprising:

receiving a data stream;

dividing the data stream into a first sub-stream and a second sub-stream by demultiplexing the data stream in an interleaved manner based on relative data density capacity of a pulse shape modulation and a pulse position modulation, wherein the first sub-stream is modulated using the pulse shape modulation and the second sub-stream is modulated using the pulse position modulation, and wherein the first sub-stream is modulated at least partially in parallel to the modulation of the second sub stream; and driving a pulser device based on the data stream, wherein driving the pulser device includes generating modulated pressure pulses including pulse position modulating pressure pulses and pulse shape modulation pressure pulses within a fluid telemetry medium.

2. The method of claim 1, wherein the pulser device comprises a valve and a valve controller configured to open and close the valve, and wherein said driving the pulser device comprises:

generating a valve control signal that encodes one or more pulses shapes corresponding to valve open or close signals; and applying the valve control signal to the valve controller.

3. The method of claim 1, wherein the modulated pulse shapes correspond to two or more amplitude contours, said method further comprising:

detecting pressure pulses transmitted across the fluid telemetry medium; and demodulating the modulated pressure pulses by decoding amplitude contours of each of the detected pressure pulses.

4. The method of claim 3, wherein decoding amplitude contours of each of the detected pressure pulses comprises:

computing time derivatives of the amplitude contours; and for each time derivative, determining at least one of a maxima differential or a minima differential; and decoding a corresponding data symbol based on the at least one of a maxima differential or minima differential.

5. The method of claim 3, wherein decoding amplitude contours of each of the detected pressure pulses comprises cross-correlating the amplitude contours of each of the detected pressure pulses with stored pulse contours corresponding to data symbols.

6. The method of claim 5, wherein said cross-correlating the amplitude contours of each of the detected pressure pulses with the stored pulse contours includes:

executing a matching function to determine correlation curves for each of the stored pulse contours across a set of the detected pressure pulses;

determining peak values for each of the correlation curves; and determining data symbols for each of the detected pressure pulses based on comparing the peak values for each of the correlation curves.

7. The method of claim 3, wherein decoding amplitude contours of each of the detected pressure pulses comprises:

for each of the detected pressure pulses, determining maxima, minima, and trailing peaks;

calculating a peak-to-peak over trailing peak ratio based on the determined maxima, minima, and trailing peaks; and determining a data symbol based on comparison of the determined peak-to-peak over trailing peak ratio with a threshold value.

8. The method of claim 3, wherein decoding amplitude contours of each of the detected pressure pulses comprises:

generating a frequency domain representation of the detected pressure pulses; and for each of the frequency domain representations of the detected pressure pulses, calculating a phase value at a specified frequency value or frequency bin; and determining a data symbol based on comparison of the calculated phase value with a threshold value.

9. The method of claim 1, wherein said pulse position modulating comprises modulating separations between pressure pulses.

10. A fluid telemetry system comprising:

a pulser device;

a receiver telemetry module configured to receive a data stream and divide the data stream into a first sub-stream and a second sub-stream by demultiplexing the data stream in an interleaved manner based on relative data density capacity of a pulse shape modulation and a pulse position modulation; wherein the first sub-stream is modulated using the pulse shape modulation and the second sub-stream is modulated using the pulse position modulation, and wherein the first sub-stream is modulated at least partially in parallel to the modulation of the second sub stream; and a control system for driving the pulser device based on the data stream, wherein driving the pulser device includes generating modulated pressure pulses including pulse position modulating pressure pulses and pulse shape modulating pressure pulses within a fluid telemetry medium.

11. The fluid telemetry system of claim 10, wherein the pulser device comprises a valve and a valve controller configured to open and close the valve, and wherein said driving the pulser device comprises:

generating a valve control signal that encodes one or more pulses shapes corresponding to valve open or close signals; and applying the valve control signal to the valve controller.

12. The fluid telemetry system of claim 10, wherein the modulated pulse shapes correspond to two or more amplitude contours, said fluid telemetry system further comprising:

a receiver configured to detect pressure pulses transmitted across the fluid telemetry medium; and a decoder configured to demodulate the modulated pressure pulses by decoding amplitude contours of each of the detected pressure pulses.

13. The fluid telemetry system of claim 12, wherein decoding amplitude contours of each of the detected pressure pulses comprises:

computing time derivatives of the amplitude contours; and for each time derivative, determining at least one of a maxima differential or a minima differential; and decoding a corresponding data symbol based on the at least one of a maxima differential or minima differential.

14. The fluid telemetry system of claim 12, wherein decoding amplitude contours of each of the detected pressure pulses comprises cross-correlating the amplitude contours of each of the detected pressure pulses with stored pulse contours corresponding to data symbols.

15. The fluid telemetry system of claim 14, wherein said cross-correlating the amplitude contours of each of the detected pressure pulses with the stored pulse contours includes:

executing a matching function to determine correlation curves for each of the stored pulse contours across a set of the detected pressure pulses;

determining peak values for each of the correlation curves; and determining data symbols for each of the detected pressure pulses based on comparing the peak values for each of the correlation curves.

16. The fluid telemetry system of claim 12, wherein decoding amplitude contours of each of the detected pressure pulses comprises:

for each of the detected pressure pulses, determining maxima, minima, and trailing peaks;

calculating a peak-to-peak over trailing peak ratio based on the determined maxima, minima, and trailing peaks; and determining a data symbol based on comparison of the determined peak-to-peak over trailing peak ratio with a threshold value.

17. The fluid telemetry system of claim 12, wherein decoding amplitude contours of each of the detected pressure pulses comprises:

generating a frequency domain representation of the detected pressure pulses; and for each of the frequency domain representations of the detected pressure pulses, calculating a phase value at a specified frequency value or frequency bin; and determining a data symbol based on comparison of the calculated phase value with a threshold value.

18. The fluid telemetry system of claim 10, wherein said pulse position modulating comprises modulating separations between pressure pulses.

19. The fluid telemetry system of claim 10, wherein said dividing the data stream comprises demultiplexing the data stream in an interleaved manner based on relative data density capacity of the pulse shape modulation and the pulse position modulation.

* * * * *